US005292603A

United States Patent [19]

Sakai et al.

[11] Patent Number: 5,292,603

[45] Date of Patent: Mar. 8, 1994

[54] IMAGE HOLDING MEMBER AND APPARATUS WHICH USES THE SAME

[75] Inventors: Kiyoshi Sakai, Tokyo; Naoto Fujimura, Kanagawa; Seiko Nakano, Mie, all of Japan

[73] Assignee: Canon Kabushiki Kaisha, Tokyo, Japan

[21] Appl. No.: 843,426

[22] Filed: Feb. 28, 1992

[30] Foreign Application Priority Data

Feb. 28, 1991 [JP] Japan ..... 3-034753

[51] Int. Cl.[5] ..... G03G 5/147; G03G 15/22; G03C 3/00

[52] U.S. Cl. ..... 430/18; 430/58; 430/66; 430/67; 430/96; 428/29; 355/211; 358/300; 358/304; 346/153.1

[58] Field of Search ..... 430/18, 58, 66, 67, 430/96; 428/29; 355/211; 358/300, 304; 346/153.1

[56] References Cited

U.S. PATENT DOCUMENTS 3,041,167 6/1962 Blakney et al. .
4,559,260 12/1985 Hirooka et al. ..... 428/215
4,740,439 4/1988 Tachikawa et al. ..... 430/54
4,943,501 7/1990 Kinoshita et al. ..... 430/66 X

FOREIGN PATENT DOCUMENTS 0207324 1/1987 European Pat. Off. .
0415446 3/1991 European Pat. Off. ..... 430/66
2941270 4/1980 Fed. Rep. of Germany .
44527 4/1979 Japan ..... 430/66
3640 1/1985 Japan ..... 430/66

OTHER PUBLICATIONS

Patent Abstracts of Japan, vol. 6, No. 156 (P-135) (1034), Aug. 17, 1982.
Patent Abstracts of Japan, vol. 13, No. 116 (P-845) (3464), Mar. 22, 1989.

*Primary Examiner*—Roland Martin
*Attorney, Agent, or Firm*—Fitzpatrick, Cella, Harper & Scinto

[57] ABSTRACT

The present invention discloses an image bearing member having a surface layer comprising a high-melting point polyester resin, a cured resin and an antioxidant, and an apparatus which uses the same.

21 Claims, 4 Drawing Sheets

IMAGE HOLDING MEMBER AND APPARATUS WHICH USES THE SAME

BACKGROUND OF THE INVENTION

1. Field of the Invention

The present invention relates to an image bearing member for bearing a static image and/or a toner image, and, more particularly, to an image bearing member exhibiting excellent durability and an apparatus which uses the same.

2. Related Art of the Invention

The image bearing members are usually classified into electrophotographic photosensitive members and other image bearing members. For example, they are exemplified by intermediate transfer members for a color copying machine in which multiple cycle of transfer operations must be performed and members such as electrostatic recording members for bearing a static image and/or a toner image.

The electrophotographic photosensitive members are structured variously in accordance with the desired characteristics or the kind of the employed electrophotographic process. As a typical electrophotographic photosensitive member used widely, there is a photosensitive member structured in such a manner that the photoconductive layer is formed on a supporting member and another photosensitive member structured in such a manner that a protection layer is formed on its surface. The photosensitive member comprising the supporting member and the photoconductive layer is used to form an image by the ordinary electrophotographic process, that is, by charging image exposure, development and, if necessary a transfer process. The protection layer of the photosensitive member having the protection layer is used to protect the photoconductive layer, improve the mechanical strength of the photosensitive member and improve the dark damping characteristics. As an alternative to this, the above-described protection layer is used so as to be subjected to a specific electrophotographic process. The above-described specific electrophotographic process is exemplified by a method which utilizes the movement of a charge, which has been injected from the supporting member at the time of the charging process, into the position between the protection layer and the photoconductive layer. The above-described method is, as disclosed in Japanese Patent Publication No. 42-23910 and Japanese Patent Publication No. 43-24748, exemplified by a method in which the static image is formed by a primary charge and a secondary charge the polarity of which opposes the polarity of the primary charge or the AC electricity removal, the simultaneous image exposure and the entire surface exposure. In the above-described method, the image exposure may be performed before or after the secondary charge or the AC electricity removal process. Furthermore, the entire surface exposure may be omitted.

Another method disclosed in U.S. Pat. No. 3,041,167 is known.

The electrophotographic photosensitive member is subjected to a predetermined electrophotographic process so that a static image is formed, the static image being then developed so that it is converted into a visible image.

Other typical image bearing members will now be described.

(1) A static image formed on an electrophotographic photosensitive member is transferred to another image bearing member to perform the development process. Then, the tone image is transferred to the recording member.

(2) As the other electrophotographic process in which a static image is formed on another image bearing member to correspond to the static image formed on the electrophotographic photosensitive member, a process is exemplified in which a static image is, by a predetermined electrophotographic process, formed on a screen-like electrophotographic photosensitive member having a multiplicity of small openings. Furthermore, the other image bearing member is subjected to a corona charging process via the above-described static image so that the corona ion flow is modulated. As a result, a static image is formed on the other image bearing member before it is toner-developed so as to be transferred to the recording member, causing a final image to be formed.

(3) Another electrophotographic process is arranged in such a manner that the toner image formed on the electrophotographic photosensitive member or the other image bearing member is not directly transferred to the recording member but the same is transferred to another image bearing member. Then, toner and the image are transferred from the above-described image bearing member to the recording member before they are fixed. The above-described process is particularly effective when a color image is formed or a high-speed copying operation is performed. Since the major portion of the recording members comprise paper or film which has flexibility, a color image, the position of which has been further accurately aligned, can be formed by method in which images of the three colors are transferred to an image bearing member which can be made of material which cannot easily be deformed before the images of the three colors are collectively transferred to a recording member. This is compared to a method in which the three color images are transferred to the recording member while accurately aligning their positions. Furthermore, the copying speed can be raised by a method in which the toner image is transferred to the recording member via the image bearing member.

(4) Another process is exemplified in which an electric signal is applied to a multi-probe electrode to form a static image which corresponds to the electric signal on the surface of the image bearing member before the static image is developed to form a desired image.

The image bearing member for use in the static-image forming processes (1) to (4) does not require a photoconductive layer.

As described above, a variety of members each having a surface layer is composed of an insulating layer such as the electrophotographic photosensitive member the surface layer of which is a protection layer or a photoconductive layer which is used as the image bearing member on which a static image or a toner image is formed.

The image bearing member must have electric characteristics which correspond to the subject recording process. Among others, durability is an important characteristic for the image bearing member, durability being a characteristic which is required in a case where the image bearing member is repeatedly used.

That is, the image bearing member must, of course, have a predetermined sensitivity level, the electric characteristics and optical characteristics of which respectively correspond to the subject electrophotographic process. In particular, since electric and mechanical external force is directly applied to the surface layer of the photosensitive member which can be used repeatedly in such processes as the corona charging, toner development, transference to paper and cleaning process, the photosensitive member of this type must have sufficient durability against the above-described external force. Specifically, the photosensitive member must have the durability against deterioration in the sensitivity, reduction in the potential and increase in the residual potential due to the deterioration caused from to the presence of ozone or $NO_x$ generated at the time of the corona charging process and surface wear and damage due to the abrasion.

In particular, the cleaning facility is an important factor which can be improved by reducing frictional resistance.

Since the surface layer of the image bearing member is mainly made of a resin and photoconductive material, the performance of the resin serves as the important role. Therefore, there is a desire for an excellent resin which is able to meet the above-described characteristics. Recently, a polycarbonate resin has been employed as the binder (a binding agent) for the surface layer because it is able to meet the above-described characteristics.

Durability of thousands to ten thousand of paper sheets realized in a case where the acrylic resin is used can be improved to a durability of fifty thousand to a hundred thousand sheets by using the polycarbonate resin. However, the durability of three hundred thousand to a million sheets realized by using Se or a-Si (amorphous Si) which is inorganic photosensitive material cannot be realized.

Therefore, a multiplicity of studies have been conducted regarding technology in which the protection layer is formed by adding a conventional resin or a resin containing fluorine. However, there arises a problem in that the residual potential (Vr) is undesirably raised or the sensitivity is deteriorated due to the repeated use of the image bearing member because of the presence of a layer of the photosensitive layer in which the charge is not moved. The above-described problem can be overcome by reducing the thickness of the protection layer to, for example, 2 to 3 μm or less. However, the conventional resin encounters a problem in that the wear due to the repeated use cannot be prevented, that is, the durability cannot be improved.

In a case where a resin, to which polytetrafluoroethylene (hereinafter sometimes abbreviated to "PTFE") is added, is used to form the protection layer, a soft resin must be used in order to cause the PTFE to exhibit its excellent cleaning facility. The reason for this lies in that the fresh PTFE must be allowed to appear outside by cutting the surface by a small quantity at each use of the photosensitive material because the effect of the PTFE cannot be obtained if a hard binder is used. If the soft binder is used, the durability of the protection layer can be improved due to the effect of the PTFE. However, a flaw can easily be formed due to the friction of the cleaning blade or a crack (separation of the film) can easily be formed due to the shock because the film is soft. Furthermore, if the front or the rear end portion of the transfer paper comes in contact with the image bearing member, the contact portion of the image bearing member is damaged, causing a problem of a black line or the like to take place. Furthermore, the conventional problems occurring in the conventional protection layer such as the increase in the residual potential and the deterioration in the sensitivity due to the repeated use cannot be overcome.

It might be considered feasible to employ a hard resin in order to improve the wear resistance. However, the coefficient of skin friction is excessively enlarged in comparison to a case in which polycarbonate or the like is used to form the surface layer. In this case, there arises a problem in that excellent cleaning facility cannot easily be obtained.

SUMMARY OF THE INVENTION

An object of the present invention is to provide: (1) an image bearing member exhibiting significantly improved durability and having a stable potential characteristic;

(2) a method of manufacturing the above-described image bearing member; and (3) a variety of apparatuses using the above-described image bearing member.

The present invention relates to an image bearing member having a surface layer containing a high-melting point polyester resin, a cured resin and an antioxidant and a method of manufacturing the same.

By forming the surface layer according to the present invention on the image bearing member, an image bearing member can be obtained, the scraping of which due to repeated use can substantially be prevented, with which a stable potential characteristic can be obtained and with which generation of an undesirable line image due to a flaw generated after the repeated use can be prevented and the density gradient due to partial scraping can be prevented. As a result, an excellent copied image can be obtained.

Other and further objects, features and advantages of the invention will be appear more fully from the following description.

DESCRIPTION OF THE PREFERRED EMBODIMENTS

Figure 1:
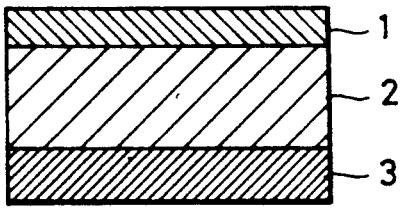
FIG. 1 is a schematic cross sectional view which illustrates an image bearing member structured according to an embodiment of the present invention.
Figure 2:
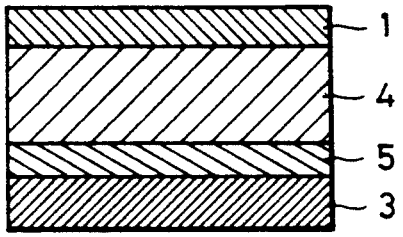
FIG. 2 is a schematic cross sectional view which illustrates the image bearing member structured according to another embodiment of the present invention.
Figure 3:
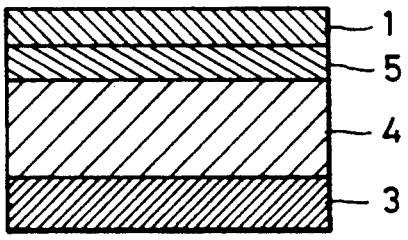
FIG. 3 is a schematic cross sectional view which illustrates the image bearing member structured according to another embodiment of the present invention.

An image bearing member according to the present invention will now be described with reference to the drawings. FIGS. 1 to 3 are schematic cross sectional views which respectively illustrate the image bearing member according to the present invention of a type having a surface layer made of a protection layer. Referring to the drawings, the same reference numerals represent the same layers.

Referring to the drawing, reference numeral 1 represents a protection layer formed at the most outer position of the image bearing member to protect the inside layers. Reference numeral 2 represents a photoconductive layer which is sometimes omitted from the image bearing member according to the present invention. Reference numeral 3 represents a supporting member, 4 represents a charge transporting layer and 5 represents a charge generating layer. The vertical positional relationship of the above-described layers is not limited to the above-described description.

Although the protection layer 1 displays excellent wear resistance, it displays small frictional resistance. Therefore, it is significantly effective when it is used as the surface protection layer of the image bearing member. It can be considered that the mixture of the high-melting point polyester resin and the cured resin causes the characteristics of each resin to act synergetically. Therefore, a novel effect which has not been realized in the conventional sole type resin or the copolymer resin can be obtained.

Since the protection layer 1 according to the present invention is strong and displays excellent tenacity, its thickness can be reduced. Therefore, the thickness of the protection layer is made to be 3 μm or less, preferably 0.1 to 2 μm. Furthermore, the photoconductive layer 2 may be provided for the image bearing member if necessary.

As the photoconductive layer, there is employed organic material having light conductivity such as Se, a-Si, ZnO, or CdS and the like or organic material having light conductivity such as organic dye, organic pigment or a polysilane compound and the like. In accordance with the structure of the layers desired, the above-described photoconductive layer may be structured in such a manner that the charge generating layer 5 is first layered on the supporting member 3 before the charge transporting layer 4 is layered. As an alternative to this, the charge transporting layer 4 is first layered on the supporting member 3 before the charge generating layer 5 is layered. As an alternative to this, the photoconductive layer has one or more layers in each of which the charge generating material and the charge transporting material are mixed. The above-described structure is arranged to comprise the minimum layers. Therefore, an intermediate layer may be provided, if necessary. If necessary, another component may be added to each layer (the protection layer may be included) according to the present invention. The above-described component to be added may comprise low molecular weight material or high molecular weight material.

Figure 4:
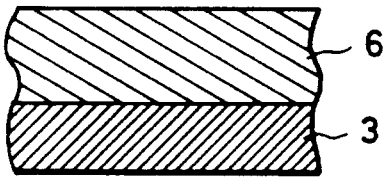
FIG. 4 is a schematic cross sectional view which illustrates the image bearing member structured according to another embodiment of the present invention.
Figure 5:
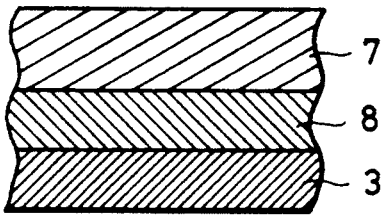
FIG. 5 is a schematic cross sectional view which illustrates the image bearing member structured according to another embodiment of the present invention.
Figure 6:
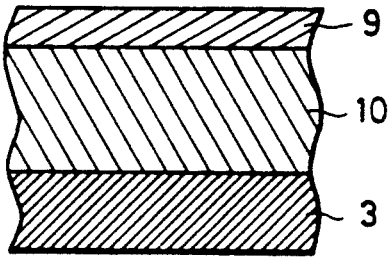
FIG. 6 is a schematic cross sectional view which illustrates the image bearing member structured according to another embodiment of the present invention.

FIGS. 4 to 6 are schematic cross sectional views which illustrate a variety of states where the image bearing member according to the present invention and having a surface layer which comprises the photoconductive layer. Referring to FIGS. 4 to 6, the same reference numerals represent the same layers.

Referring to FIGS. 4 to 6, reference numeral 6 represents a photoconductive layer which is made of a high-melting point polyester resin, a cured resin, an oxidant inhibitor, charge generating material and charge transporting material. Reference numeral 3 represents a supporting member, 7 represents a charge transporting layer which is mainly made of the charge transporting material, the high-melting point polyester resin, the cured resin and the oxidant inhibitor. Reference numeral 8 represents a charge generating layer which is mainly made of the charge generating material. Reference numeral 9 represents the charge generating layer which is made of the charge generating material, the high-melting point polyester resin, the cured resin and the oxidant inhibitor. Reference numeral 10 represents a charge transporting layer which is mainly made of the charge transporting material.

As the photoconductive layer, inorganic material having light conductivity such as Se, a-Si (amorphous Si), ZnO, or CdS and the like or organic material having light conductivity such as organic dye, organic pigment and a polysilane compound and the like is employed. In accordance with the structure of the layers desired, the above-described photoconductive layer may be structured in such a manner that the charge generating layer is first layered on the supporting member before the charge transporting layer is layered. As an alternative to this, the charge transporting layer is first layered on the supporting member before the charge generating layer is layered. As an alternative to this, the photoconductive layer has one or more layers in each of which the charge generating material and the charge transporting material are mixed. The above-described structure is arranged to comprise the minimum layers. Therefore, an intermediate layer may be provided, if necessary.

Next, the description will be made about the resin components for forming the surface layers of the image bearing member according to the present invention such as the protection layer 1, the photoconductive layer 6, the charge transporting layer 7 and the charge generating layer 9.

As the term employed in the phrase "high melting point polyester resin", polyester is defined as a condensed polymer composed of an acid component and an alcohol component and as well as a polymer which can be obtained by condensing dicarboxylic acid and glycol or by condensing a compound such as hydroxybenzoic acid having a hydroxy group and a carboxyl group.

As the acid component, the following material may be used: aromatic dicarboxylic acid such as terephthalic acid, isophthalic acid, and naphthalene dicarboxylic acid; aliphatic dicarboxylic acid such as succinic acid, adipic acid, and sebacic acid; alicyclic dicarboxylic acid such as hexahydroterephthalic acid; and oxycarboxylic acid such as hydroxyethoxy benzoic acid.

As the glycol component, the following material may be used: ethylene glycol, trimethylene glycol, tetramethylene glycol, hexamethylene glycol, cyclohexane dimethylol, polyethylene glycol, polypropylene glycol or the like.

Furthermore, while keeping the range in which the above-described polyester resin is formed into a substantially linear shape, a multifunctional compound such as a pentaerythritol, trimethylol propane, pyromellitic acid and their ester forming derivatives may be copolymerized.

As the polyester resin according to the present invention, a high-melting point polyester resin is used.

As the high-melting point polyester resin, there may be used material displaying a limit viscosity of 0.4 dl/g or more when measured at 36° C. in orthochlorophenol, preferably 0.5 dl/g or more, further preferably 0.65 dl/g or more.

As a preferable high-melting point polyester resin, a polyalkylene terephthalate resin is exemplified. The polyalkylene terephthalate resin is mainly composed of terephthalic acid as its acid component and alkylene glycol as its glycol component.

The polyalkylene terephthalate resin is exemplified by: polyethylene terephthalate (PET) mainly composed of a terephthalic acid component and an ethylene glycol component, Polybutylene terephthalate (PBT) mainly composed of a terephthalic acid component and a 1,4-tetramethylene glycol (1,4-buthylene glycol) component and polycyclohexyldimethylene terepthalate (PCT) mainly composed of a terepthalic acid component and a cyclohexanedimethylol component. As another preferable high molecular weight polyester resin, a polyalkylene naphthalate resin is exemplified. The polyalkylene naphthalate resin is composed of a naphthalene dicarboxylic acid component as its acid component and an alkylene glycol component as its glycol component. It is exemplified by polyethylenenaphthalate (PEN) which is mainly composed of a naphthalene dicarboxylic acid component and an ethylene glycol component.

It is preferable that the high-melting point polyester resin has a melting point of 160° C. or higher, preferably 200° C. or higher.

Since the high-melting point polyester resin has a high-melting point, it displays a high crystallinity. As a result, it can be considered that the entanglement of the cured resin polymer chain and the high-melting point polymer chain becomes uniform and high density so that the surface layer exhibiting satisfactory durability is formed. Since the low melting point polyester resin has a low crystallinity, the entanglement with the hard resin polymer chain cannot be made uniform. As a result, the durability deteriorates.

At last one of the following thermoplastic resins may be added to the high-melting point polyester resin in a range in which its characteristics are not deteriorated: polycarbonate, polyamide, polyarylate, polyoxymethylene, polyphenyleneoxide, polyphenylenesulfide, polyethylene, polypropylene, ethylene and propylene copolymer, polystyrene, styrene and butadiene copolymer or oligomer of a saturated polyester resin.

The cured resin component according to the present invention is a resin which is polymerized and which generates a cross linking by heat, preferably by a photopolymerization initiator, a cross linking agent or an application of light such as ultraviolet rays. It is preferable that the cured resin component be made of a ionic polymerizing or cross linking cured resin. It can be considered that the polymerization and forming of the cross linking in the ionic polymerizing or cross linking cured resin are not prevented by oxygen contained in the air and thereby curing propagates equally in the direction of the thickness of the surface layer. Thus, the surface layer exhibiting further improved durability can be formed. The light ionic cured resin is exemplified by an epoxy resin, a urethane resin, a phenol resin, a melamine resin, an acrylic resin and a silicone resin, preferably, a cation polymerizing resin component is exemplified.

Its is preferable that the cation polymerizing resin comprises a cation polymerizing resin the main component of which is an epoxy resin having two or more oxirane ring in one molecule thereof or a mixture of the above-described polymerizing resins. The epoxy resin of this type is exemplified by an aromatic epoxy resin, a novolak type epoxy resin and an alicyclic epoxy resin.

The aromatic epoxy resin of this type is exemplified by Epicoat 828, Epicoat 834, Epicoat 836, Epicoat 1001, Epicoat 1004, Epicoat 1007, Epicoat 190P and Epicoat 191P (each of which is a trade name of Oil Shell Epoxy Co., Ltd.), DER331, DER332, DER661, DER664 and DER667 (each of which is a trade name of Dow Chemical) and Araldite 260, Araldite 280, Araldite 6071, Araldite 6084 and Araldite 6097 (each of which is a trade name of Ciba-Geigy. The above-described resin may be used solely or in a mixed manner.

The above-described novolak type epoxy resin is exemplified by Epicoat 152 and Epicoat 154 (each of which is a trade name of Oil Shell Epoxy Co., Ltd.), Araldite EPN1138, Araldite EPN1139, Araldite ECN1235, Araldite ECN1273, Araldite ECN1280 and Araldite ECN1299 (each of which is a trade name of Ciba-Geigy). The above-described resin may be used solely or in a mixed manner.

The alicyclic epoxy resin is exemplified by Araldite CY175, Araldite CY177, Araldite CY179 and Araldite CY192 (each of which is a trade name of (Ciba-Geigy). The above-described resin may be used solely or in a mixed manner.

A butadiene type epoxy resin or the like may be used and as well as material to which each of the above-described epoxy resins is mixed may be used.

A monofunctional epoxy diluent may be added to the cation polymerizing compound according to the present invention by a quantity with which the curing characteristics are not deteriorated. The monofunctional epoxy diluent is exemplified by phenylglycidyl ether, *t*-butylglycidyl ether and the like.

The cation polymerizing vinyl compound may be mixed with the above-described epoxy resin, the cation polymerizing vinyl compound being exemplified by: styrene, allylbenzene, triallylisocyanate, triallylcyanate, vinyl ether, N-vinyl carbazole and N-vinyl pyrolidone.

Although the process of curing the cured resin may be performed by using heat, it is preferable that light curing be performed by applying ultraviolet rays.

When the cured resin is hardened by light, a photopolymerization initiator is added. The photopolymerization initiator for freeing Lewis acid for commencing the polymerization of the cation polymerizing component with ultraviolet rays applied is exemplified by aromatic diazonium salt, aromatic halonium salt and photosensitive aromatic onium salt of the group VIb or group Vb.

The aromatic diazonium salt is a compound expressed by the following general formula (1):

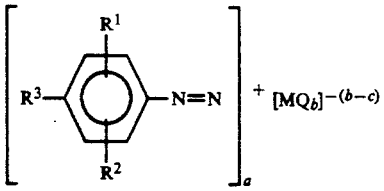

(I)

[where $R^1$, $R^2$ are hydrogen atoms, alkyl groups or alkoxy groups, $R^3$ is a hydrogen atom, an aromatic group or an aromatic group connected by an amide group or a sulfur group, M is metal or semimetal and Q is a halogen atom, a is a number from 1 to 6 while having a relationship $a=(b-c)$, b is a number having a relationship $c<b\leqq 8$ and c is a number from 2 to 7 which is the same as the valence of M]

It is exemplified by the following compounds:

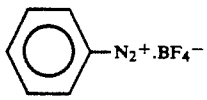

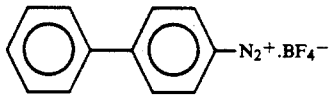

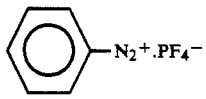

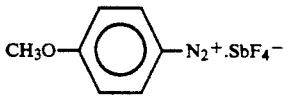

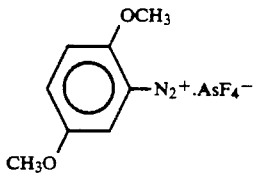

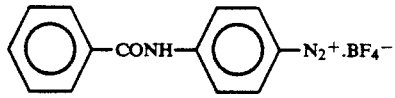

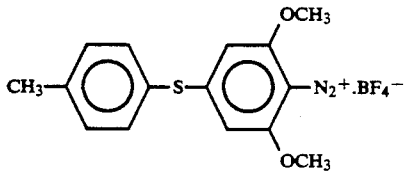

The above-described aromatic halonium salt is a compound expressed by the following general formula:

$$[(R^4)_d(R^5)_eX]^+_f[MQ_g]^{1-(g-n)} \quad (2)$$

[where $R^4$ is a univalent organic group of the aromatic group, $R^5$ is a bivalent organic group of the aromatic group, X is, for example, a halogen atom such as I, Br and Cl, M is metal or semimetal, Q is a halogen atom, d is 0 or 2, e is 0 or 1, g is a number which has a relationship $h<g\leqq=8$ and as well as $(d+e)$ is the same as the valence of X]. Specifically, it is exemplified by:

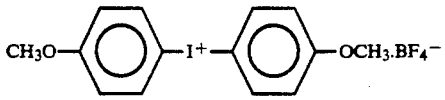

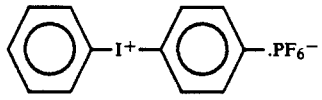

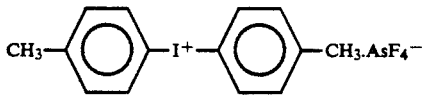

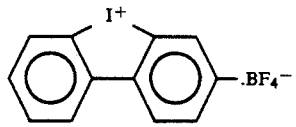

Furthermore, the photosensitive onium salt of the aromatic group of the group VIb or Vb is a compound expressed by the following general formula (3):

$$[(R^6)_i(R^7)_j(R^8)_kY]^+_1[MQ_m]^{-(m-n)} \quad (3)$$

[where $R^6$ is a univalent organic group of the aromatic group, $R^7$ is a univalent organic group of the aliphatic group selected from a group consisting of an alkyl group, a cycloalkyl group and a substituted alkyl group, $R^8$ is a polyvalent organic group selected from a group consisting of an organic group of the aliphatic group and an organic group of the aromatic group, Y is an element of the group VIb selected from a group consisting of S, Se and Te or an element of the Vb group selected from a group consisting of N, P, Ss, Sb and Bi, M is metal or semimetal, Q is a halogen atom, i is an integer from 0 to 4, j is an integer from 0 to 2, k is an integer from 0 to 2, $(i+j+k)$ is the same as the valency of Y and it is 3 in a case where Y is an element of the group VIb but it is 4 in a case where Y is an element of the group Vb, a relationship $i=(m-n)$ is held, m is a number which has a relationship $n<m\leqq 8$ and n is an integer which is the same as the valency of M].

The onium salt of the group VIb and exemplified by:

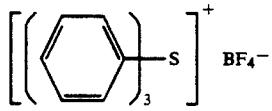

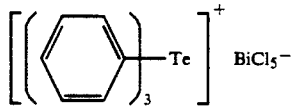

-continued

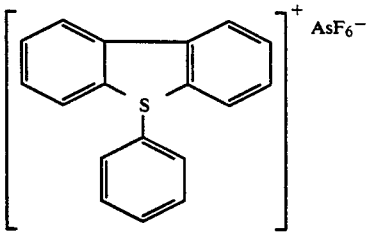

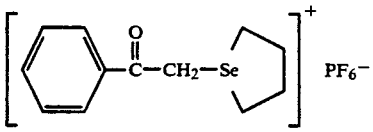

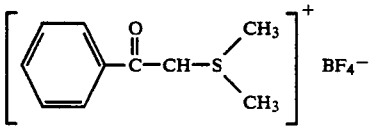

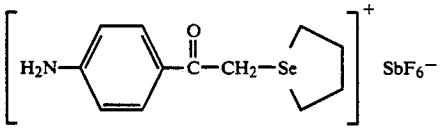

The onium salt of the group Vb is exemplified by:

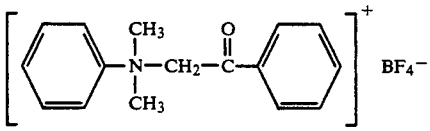

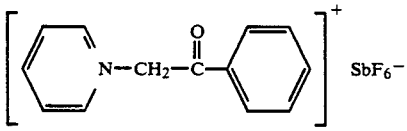

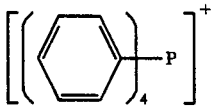

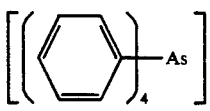

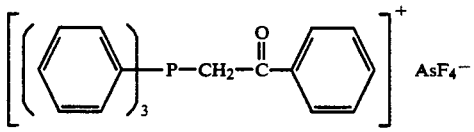

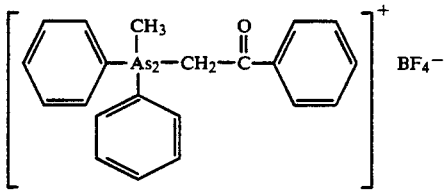

The antioxidant according to the present invention is able to prevent the deterioration of the photosensitive layer due to oxidation while preventing the deterioration of the sensitivity.

It is preferable that the antioxidant according to the present invention be a slow reducer exemplified by: phenol such as dibutyl hydroxytoluene, 2,2'-methylenebis(6-*t*-butyl-4-methylphenol), 4,4'-butylidene-bis(6-*t*-butyl-3-methylphenol), 4,4'-thiobis(6-*t*-butyl-3-methylphenol), 2,2'-butylidenebis(6-*t*-butyl-4-*t*-methylphenol), α-tocopherol β-tocopherol and 2,2'4-trimethyl-6-hydroxy-7-*t*-butylchroman; hydroxyanisole such as butylhydroxyanisole and dibutylhydroxyanisole; hydroquinone such as 2,5-di-*t*-octylhydroquinone, 2,6-di-n-dodecylhydroquinone, 2,*n*-dodecylhydroquinone, 2-n-dodecyl-5-chlorohydroquenone, 2-6-octyl-5-methylhydroquinone and 2-(2-octadecyl)-5-methylhydroquinone; sulfur compound such as dilauryl-3,3'-thiodipropionate and distearyl-3,3'-thiodipropionate; an organic phosphorus compound such as triphenyl phosphorus, tris (nonylphenyl) phosphorus, tris (dinonylphenyl) phosphorus and tricresol phosphorus; and paraphenylenediamine such as N-phenyl-N'-isopropyl-P-phenylenediamine. It is very preferable that the above-described compound be added because the addition of them do not cause the sensitivity to be deteriorated. Although the quantity of the antioxidant usually varies depending upon the type of the compound employed, it is preferable that it be added by 0.01 to 4 wt % of the total weight of the above-described high-melting point polyester resin and the cured resin, preferably 0.04 to 2 wt %.

It is preferable that the resin composition according to the present invention be applied to the base after it has been dissolved in a solvent.

The solvent in which the resin composition according to the present invention is dissolved may comprise a solvent which is able to dissolve the high-melting point polyester resin. It is preferable that any one of the following materials or their mixture be used: hydrocarbon halide such as cresol, chloroform, dichloroethane, tetrachloroethane, trichloropropane and tetrachlorobenzene; alcohol containing fluorine such as tetrafluoroethanol and hexafluoroisopropanol.

It is significantly preferable to employ a solvent comprising any one of the following materials or their mixture: alcohol containing fluorine such as tetrafluoroethanol and hexafluoroisopropanol. The above-described alcohol containing fluorine displays an advantage in comparison to an ordinary chloride type solvent in that each of the above-described materials does not affect the electrophotographic process and displays satisfactory durability against high temperature and high humidity environment.

The mixture ratio of the cured resin with respect to 100 parts by weight of the high-melting point polyester resin is made to be 3 to 50 parts by weight, preferably 8 to 45 parts by weight, further preferably 10 to 40 parts by weight. The mixture ratio of the above-described Lewis acid freeing type photopolymerizing initiator with respect to 100 parts by weight of the cured resin is made to be 0.1 to 50 parts by weight, preferably 1 to 30 parts by weight. As the method of applying it, an arbitrary method such as a dipping method and a method in which a roll coater, a bar coater, a spray or a brush is used may be employed. In particular, it is preferable that the dipping method be employed because the formed film displays excellent uniformity.

The ultraviolet ray irradiation is from room temperature to a temperature at which the high molecular polyester resin is decomposed, preferably a temperature higher than the glass transition temperature as well as lower than the solution commencement temperature, further preferably a temperature high than the glass transition temperature by 20° C. or more and as well as lower than the solution commencement temperature by 20° C. or more. The irradiation period is made to be 60 seconds or shorter, preferably 30 seconds or shorter, further preferably 5 to 15 seconds.

The irradiation conditions are properly determined depending upon the quantity of the cross linking material which is not dissolved in the solvent. The ultraviolet rays of the wavelength of 200 to 500 nm, preferably 300 to 400 nm is used.

The surface layer composed of a specific resin component and according to the present invention is subjected to the curing process in which 100 mg of material which is obtained by curing it is stirred and dissolved in 10 ml of the solvent while being heated at 100° C. for one hour before it is filtered and cleaned by a 3G filter. Then, it is irradiated with the ultraviolet rays until the quantity of the undissolved portion (gel), after it has been dried up to the constant temperature of 130° C., becomes 10 wt % or more, preferably 15 wt %, further preferably 20 wt %.

The supporting member for the image bearing member according to the present invention is exemplified by the following material:

(1) A material obtained by forming metal such as aluminum, an aluminum alloy, corrosion-resisting steel (stainless steel) and copper into a plate-like shape or a drum-like shape.

(2) A thin film formed by evaporating or laminating metal such as aluminum, palladium, rhodium, gold or platinum or the like on the non-conductive supporting member such as glass, resin, paper or the like or the above-described conductive supporting member (I).

(3) A material formed by evaporating a conductive compound such as conductive polymer, tin oxide and indium oxide or by applying as a dispersed paint with the conductive or non-conductive polymer on the non-conductive supporting member such as glass, resin, paper or the like or the above-described conductive supporting member (I).

An undercoat layer having a barrier function or an adhesion function may be formed between the supporting member and the photoconductive layer. The thickness of the undercoat layer is made to be 5 μm or less, preferably 0.1 to 3 μm. The undercoat layer may be formed by, for example, casein, polyvinyl alcohol, nitrocellulose, polyamide (nylon 6, nylon 66, nylon 610, copolymer nylon, N-alkoxymethyl nylon or the like), polyurethane or aluminum oxide or the like.

An effective charge generating material according to the present invention is exemplified as follows in such a manner it may comprise a sole material or a mixture:

(1) azo pigment: monoazo, bisazo, trisazo pigment;

(2) phthalocyanine pigment: metal-phthalocyanine, non-metallic phthalocyanine pigment;

(3) indigo pigment: indigo, thioindigo;

(4) perylene pigment: perylene acid anhydride, perylene acid imide;

(5) polycyclic quenone pigment: condensed ring compound such as anthraquinone and pyrenequinone;

(6) squarilium pigment:

(7) pyrylium salt, thiopyrylium salt;

(8) triphenylmethane pigment;

(9) inorganic material such as selenium and amorphous silicon

The layer containing the charge generating material, that is, the charge generating layer can be formed by dispersing the above-described charge generating material into, for example, a proper binding agent before it is applied to the surface of the supporting member. As an alternative to this, the layer can be formed by forming a thin film on the supporting member 4 by a dry process such as the evaporating method, sputtering method and the CVD method.

The above-described binding agent (binder) can be selected from a variety of binding resins exemplified by a polycarbonate resin, a polyester resin, a polyarylate, a butyral resin, a polyvinylacetal resin, diarylphthalate resin, acrylic resin, methacrylate resin, a vinyl acetate resin, a phenol resin, a silicon resin, a polysulfone resin, a styrene-butadiene copolymer resin, an alkyd resin, an epoxy resin and a urea resin and vinylchloride-vinyl acetate copolymer resin. The present invention is not limited to the above-described description.

The above-described material may be used in a sole form, in the form of a copolymer or in the form of a mixture consisting of one or more materials described above. The quantity of the resin to be contained in the charge generating layer is made to be 80 wt % or less, preferably 0 to 40 wt %. It is preferable that the above-described charge generating layer be a thin film layer having a thickness of 5 μm or less, preferably 0.01 μm to 1 μm.

Furthermore, any one of a variety of sensitizing agents may be added to the charge generating layer.

The charge transporting layer is formed above or below the charge generating layer and arranged to receive the charge carrier supplied from the charge generating layer under the presence of an electric field so as to transport the charge carrier. The charge transporting layer 5 can be formed by dissolving the charge transporting material into a solvent together with a proper binder if necessary before the solution is applied to the desired portion. The thickness of the charge transporting layer is usually made to be 5 to 40 μm, preferably 15 to 30 μm.

The charge transporting materials are classified into the electron transporting material and hole transporting material. The electron transporting material is exemplified by electron absorbing material such as 2,4,7-trinitrofluorenone, 2,4,5,7-tetranitrofluorenone, chloroanil, tetracyanoquinodimethane and the like or material prepared by polymerizing the above-described electron absorbing material.

The hole transporting material is exemplified by a polycyclic aromatic compound such as pyrene and anthracene; a heterocyclic compound such as carbazole, indole, imidazole, oxazole, thiazole, oxadiazole, pyrazole, pyrazoline, thiadiazole and triazole; a hydrazone compound such as p-diethylaminobenzaldehyde-N, N-diphenylhydrazone and N,N-dipheylhydrazino-3-methylidine-9-ethylcarbazole; a styryl compound such as α-phenyl-4'-N,N-diphenylaminostilbene and 5-[4-(di-p-triamino) benzilidene]-5H-dibenzo [a,d] cycloheptene; a benzidine compound; a triaryl methane compound and triphenylamine or a polymer (for example, poly-N-vinylcarbazole or polyvinylanthracene) having a group composed of any of the above-described compound as its backbone chain or the side chain.

In addition to the above-described organic charge transporting material, inorganic material such as selenium, selenium-tellurium, amorphous silicon (α-Si) and cadmium sulfide may be used.

The above-described charge transporting material may be used solely or in the form of a mixture.

In a case where the charge transporting material wants the film forming ability, a proper binder (binding resin) may be used which is exemplified by: an insulating resin such as acrylic resin, polyarylate, polyester, polycarbonate, polystyrene, acrylonitrile-styrene copolymer resin, polysulfone, polyacrylamide, polyamide and chrorinated rubber or an organic photoconductive polymer such as an elastomer, poly-N-vinylcarbazole and polyvinylanthracene.

As another embodiment of the present invention, there is provided an image bearing member which contains the above-described azo pigment and the charge transporting material in one layer. In this state, a charge transporting complex composed of poly-N-vinylcarbazole and trinitrofluorenone as the charge transporting material.

The image bearing member according to this embodiment can be formed by a process in which liquid prepared by dispersing the above-described azo pigment and the charge transporting material in a proper resin solution is applied to the surface of the supporting member before a drying process is performed.

The image bearing member having the photoconductive layer according to the present invention can be, as the electrophotographic photosensitive material, used not only in an electrophotographic copying machine but also in an electrophotographic application field such as in a laser beam printer, a CRT printer, an LED printer, a liquid crystal printer, a laser engravement and a printer for a facsimile machine.

The image bearing member according to the present invention and having no photoconductive layer is exemplified by a structure arranged in such a manner that the surface layer is formed on the supporting member for the purpose of bearing a static latent image or a toner image. As an alternative to this, it is exemplified by a structure in which the surface layer is formed on the supporting member via a dielectric layer. The surface layer is exemplified by a structure which is formed into a layer which includes the high-melting point polyester resin and the cured resin, in particular, a light ion cured resin and antioxidant.

As an example of an application of the image bearing member having no photoconductive layer is exemplified by an intermediate transfer member of a static recording member of the toner layer or the static latent image.

Figure 7:
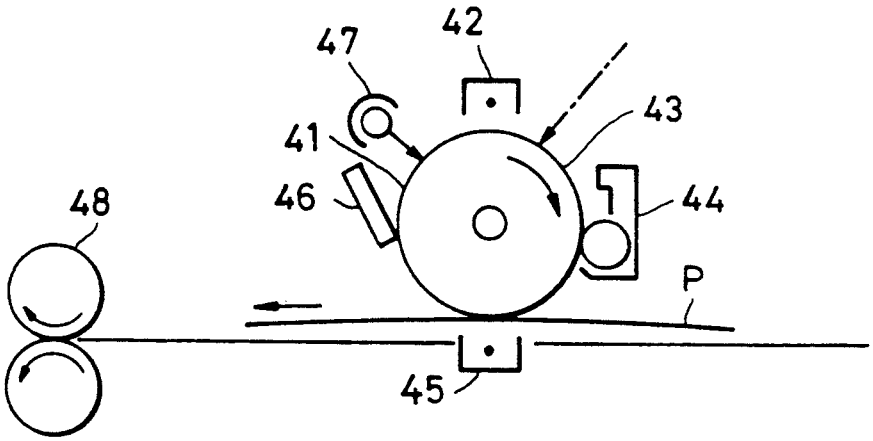
FIG. 7 is a schematic structural view which illustrates a transfer type electrophotographic apparatus having an ordinary drum-type electrophotographic photosensitive member.
Figure 8:
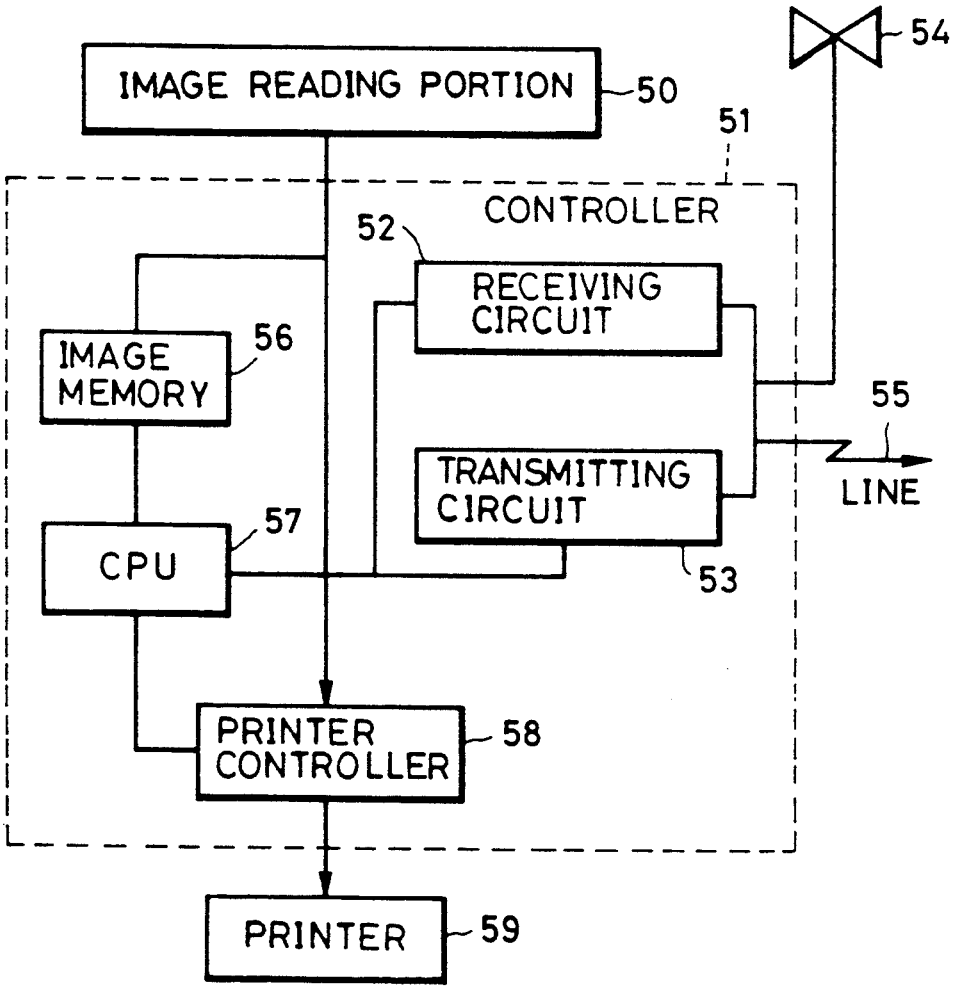
FIG. 8 is a block diagram which illustrates a facsimile system in which the above-described electrophotographic apparatus is used as a printer.

FIG. 7 illustrates the schematic structure of an ordinary transfer type electrophotographic apparatus which uses a drum-type photosensitive member to which the image bearing member according to the present invention is fastened.

Referring to FIG. 7, reference numeral 41 represents a drum-type photosensitive member serving as the image bearing member which is rotated at a predetermined circumferential speed in a direction designated by an arrow around a shaft 41*a*. The above-described photosensitive member 41, on the outer surface thereof, receives a uniform charge of a positive or negative potential due to the action of a charging means 42. Then, an exposure portion 43 of the drum-type photosensitive member 41 is subjected to an image exposure (slit exposure or laser beam scanning exposure or the like) by an image exposure means (omitted from illustration). As a result, static latent images which correspond to the exposed image are sequentially formed on the surface of the photosensitive member.

The static latent images thus-formed are toner developed by a development means 44 before the developed images are sequentially transferred by a transfer means 45 to transfer member P which has been supplied from a paper supply portion (omitted from illustration) to a portion between the photosensitive member 41 and the transfer means 45 in synchronization with the rotation of the photosensitive member 41.

The transfer member P to which the image has been transferred is separated from the surface of the photosensitive member before it is introduced into an image fixing means 48 so that the image is fixed. Then, it is printed out outside the apparatus as a copy.

The surface of the photosensitive member 41 is subjected to a process in which the residual toner is removed by a cleaning means 46 so that the surface of the photosensitive member 41 is cleaned. Therefore, it can be repeatedly used for forming images.

A corona charging apparatus is widely used as the uniform charging means 42 for charging the photosensitive member 41. The corona transfer means is widely used also as the transfer apparatus 45. The electrophotographic apparatus may be arranged in such a manner that a unit in which a plurality of elements selected from the above-described photosensitive member 41, the developing means 44 and the cleaning means 46 are integrally combined is constituted and the unit thus-arranged is made to be detachable from the apparatus body. For example, a unit is constituted by integrating the photosensitive member 41 and the cleaning means 46 and the unit thus-constituted is made to be detachable from the apparatus body by using a guide means such as a rail. The structure may be arranged in such a manner that the charging means 42 and/or the developing means 44 is disposed in the unit.

A single unit which is detachable from the apparatus unit may include at least one of the charging means, developing means and cleaning means which is integrally supported with the image bearing member having the instant surface layer.

In a case where the electrophotographic apparatus is used as a copying machine or a printer, the image exposure L is performed in such a manner that light reflected from the original document, transmitted light or the original document is formed into a read signal. Then, the scanning with the laser beam, driving of a light emitting diode array and driving of a liquid crystal shutter array are performed in response to the above-described signal.

In a case where the electrophotographic apparatus is used as a printer of a facsimile machine, the image exposure is performed for the purpose of printing received data. FIG. 5 is a block diagram which illustrates an example of this case.

Referring to FIG. 5, a controller 51 controls an image reading portion 50 and a printer 59. The overall operation of the controller 51 is controlled by a CPU 57. Read data obtained by the image reading portion 50 is transmitted to the corresponding terminal via a transmitting circuit 53.

Data transmitted from the corresponding terminal is supplied to a printer 59 via a receiving circuit 52. An image memory 56 stores a predetermined image data. A printer controller 58 controls the printer 59. Reference numeral 54 represents a telephone.

An image (image information supplied through a remote terminal connected via a line) supplied from a line 55 is demodulated by the receiving circuit 52. Then, image information is demodulated by a CPU 57 before it is sequentially stored in the image memory 56. When image of a quantity corresponding to at least one page is stored in the image memory 56, the image of this page is recorded. The CPU 57 reads image information for one page from the image memory 56 before it transmits demodulated image-information for one page to the printer controller 58. The printer controller 58 receives image information for one page supplied from the CPU 57 to control the printer 59 in order to record image information about the page. The CPU 57 receives information about next page during the recording operation performed by the printer 59.

The image is received and recorded by using, as the printer, the electrophotographic apparatus to which the image bearing member according to the present invention is fastened.

EXAMPLE 1-1

An aluminum cylinder arranged such that the outer diameter was 80 mm and the length was 360 mm was used as the base before 5% methanol solution of alkoxymethyl nylon was applied to the base by the dipping method so that an undercoat layer (intermediate layer) the thickness of which was 1 μm was formed.

Then, 10 parts (hereinafter by weight) of a pigment the constitutional formula of which was expressed as follows, 8 parts of polyvinylbutyral and 50 parts of cyclohexanone were mixed and dispersed for 20 hours in a sand mill apparatus which used 100 parts of glass beads the diameter of each of which was 1 mm:

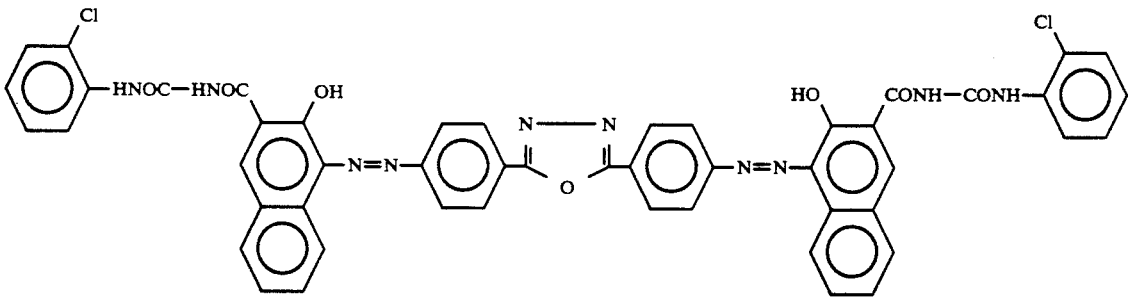

The dispersed liquid thus-prepared was applied to the surface of the undercoat layer after 70 to 120 (a proper quantity) parts of methylethylketone had been added to the dispersed liquid before drying was performed at 100° C. for 5 minutes so that a charge generating layer the thickness of which was 0.2 μm was formed.

Then, 10 parts of a styryl compound the constitutional formula of which was expressed as follows and 10 parts of bisphenol Z-type polycarbonate were dissolved in 65 parts of monochlorobenzene. The solution thus-prepared was applied to the base by a dipping method before drying was performed with hot air at 120° C. for 60 minute so that a charge transporting layer the thickness of which was 20 μm was formed.

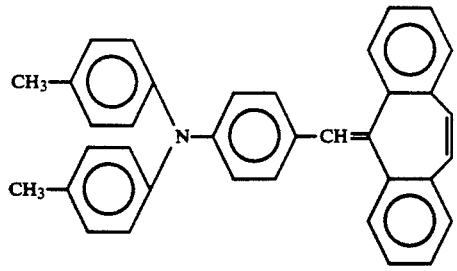

Then, a protection layer the thickness of which was 1.0 μm was formed on the charge transporting layer by the following method:

100 parts by weight of high-melting point polyethylene terephthalate (A)(the limit viscosity was 0.70 dl/g, the melting point was 258° C. (measured by using a differential thermal meter at a temperature rising speed of 10° C./minute and a 5 mg sample to be measured was prepared in such a manner that a polyester resin was melted at 280° C. before it was rapidly cooled with cold water the temperature of which was 0° C., the above-described method being common to the ensuing examples)(the glass transition temperature was 70° C.) and 30 parts by weigh of epoxy resin (B)[aromatic ester type material the epoxy equivalence of which was 160; trade name: Epicoat 190P (manufactured by Oil Shell Epoxy)] were dissolved in 100 ml mixture solution of phenol and tetrachloroethane (1:1). Then, 3 parts of triphenyl sulfonium hexafluoroanthimonate (C) were added as the photopolymerizing initiator before 0.1 parts by weight of 3,5-di-*t*-butyl-4-pyroloxytoluene was added as the antioxidant. As a result, a resin composition solution was prepared.

The light irradiation conditions for curing the sample were made in such a manner that a 2 kw high pressure mercury lamp (30 w/cm) was disposed at a distance of 20 cm to irradiate the subject at 130° C. for 8 seconds.

The photosensitive drum thus-manufactured was mounted on a copying machine [Trade name: NP-3525 (manufactured by Canon Inc.] Then, a durability test in which six hundred thousand paper sheets durability was evaluated at a temperature of 24° C. and the relative humidity of 55%. The results are shown in Table 1-1.

COMPARATIVE EXAMPLE 1-1

A photosensitive member constituted similarly to that according to Example 1-1 was manufactured except for the protection layer according to Example 1-1 was not used. Then, a durability test was performed similarly to Example 1-1. The results are shown in Table 1-1.

COMPARATIVE EXAMPLE 1-2

As the binder for use in the charge transporting layer (CTL) in place of the protection layer according to Example 1-1, 4 parts by weight of bisphenol Z-type polycarbonate 70 parts by weight of monochlorobenzene and 1 part by weigh of PTFE fine powder were mixed and dispersed by a sand mill for 10 hours so that coating liquid was manufactured. The coating liquid was applied by the spray method to the surface of the CTL to realize a thickness of 1.0 μm so that the protection layer was manufactured. Then, a durability test was performed by a method similarly to Example 1-1. The results are shown in Table 1-1.

COMPARATIVE EXAMPLE 1-3

The coating liquid was re-prepared to make the thickness of the protection layer according to the comparative example 1-2 to be 12.0 μm so that a protection layer the thickness of which was 12.0 μm by spray coating. Then, the durability test was performed by a method similarly to Example 1-1. The results are shown in Table 1-1.

The photosensitive drum thus-manufactured was mounted on a copying machine [Trade Name: NP-3525 (manufactured by Canon Inc.]. Then, the six hundred thousand paper sheet durability test was performed by a manner similar to Example 1-1. The results are shown in Table 1-1.

EXAMPLE 1-2

A test was performed similarly to Example 1-1 except for the arrangements made that a high-melting point polyester resin (limit viscosity: 0.68 dl/g, the melting point 210° C., glass transition temperature: 68° C.) prepared by using terephthalic acid as the acid component, 80 mol % ethylene glycol and 20 mol % polyethylene glycol [the molecular weight: 1000] as the glycol components was used and 0.2 parts by weight of 3-t-butyl-4-hydroxyanisole was employed as the antioxidant. The results are shown in Table 1-1.

EXAMPLE 1-3

A test was performed similarly to Example 1-1 except for the arrangements made that a high-melting point polyester resin (limit viscosity: 0.67 dl/g, the melting point: 195° C., glass transition temperature: 65° C.) prepared by using terephthalic acid as the acid component, 63 mol % ethylene glycol and 37 mol % polyethylene glycol as the glycol components was used and 0.3 parts by weight of 2,2'-methylenebis (6-t-butyl-4-methylphenol) was employed as the antioxidant. The results are shown in Table 1-1.

EXAMPLE 1-4

A test was performed similarly to Example 1-1 except for the arrangements made that a high-melting point polyester resin (limit viscosity: 0.66 dl/g, the melting point: 180° C., glass transition temperature: 64° C.) prepared by using a mixture of terephthalic acid as the acid component and 50 mol % ethylene glycol and 50 mol % polyethylene glycol as the glycol component was used and 0.2 parts by weight of α-tocopherol was employed as the antioxidant. The results are shown in Table 1-1.

EXAMPLE 1-5

A test was performed similarly to Example 1-1 except for the arrangements made that a high-melting point polyester resin (limit viscosity: 0.64 dl/g, the melting point: 161° C., glass transition temperature: 60° C.) prepared by using a mixture of terephthalic acid as the acid component, 40 mol % ethylene glycol and 60 mol % polyethylene glycol as the glycol components was used and 0.5 parts by weight of dibutylhydroxyanisole was employed as the antioxidant. The results are shown in Table 1-1.

EXAMPLE 1-6

A test was performed similarly to Example 1-5 except for the arrangements made that an epoxy resin [a bisphenol type resin the epoxy equivalence of which was 184 to 194 and the trade name of which was Epicoat 828 (manufactured by Oil Shell Epoxy] was employed as the thermosetting resin and 1 part by weight of 2,5-di-*t*-octylhydroquinone was employed as the antioxidant. The results are shown in Table 1-1.

EXAMPLE 1-7

A photosensitive member constituted similarly to that according to Example 1-1 was manufactured except for the arrangements made such that the quantity of the epoxy resin according to Example 1-1 was made to be 10 parts and 1.5 parts by weight of 2-*t*-octyl-5-methylhydroquinone was used as the antioxidant. Then, the durability test was performed similarly to Example 1-1. The results are shown in Table 1-1. The thickness of the employed protection layer was 0.8 μm.

EXAMPLE 1-8

A photosensitive member constituted similarly to that according to Example 1-5 was manufactured except for the arrangements made such that the high pressure mercury lamp according to Example 1-1 was operated for 5 seconds and 1.8 parts by weight of dilauryl-3,3'-thiopropionate was used as the antioxidant. Then, the durability test was performed similarly to Example 1-1. The results are shown in Table 1-1. The thickness of the employed protection layer was 0.9 μm.

EXAMPLE 1-9

An aluminum cylinder the outer diameter of which was 80 mm and the length of which was 360 mm was used as the base. Then, a 5% methanol solution of alkoxymethylated nylon according to Example 1-1 was applied to the base so that an undercoat layer (intermediate layer) having a thickness of 1 μm was formed. Then, by using a sand mill, coating liquid was prepared by mixing and dispersing 3 parts by weight of ε-type Cu-PC serving as charge generating material, 6 parts by weight of hydrazone compound serving as the charge transporting material, 6 parts by weight of bisphenol type polycarbonate according to Example 1-1 and 50 parts by weight of monochlorobenzene for 30 hours, the constitutional formula of hydrazone compound being expressed as follows:

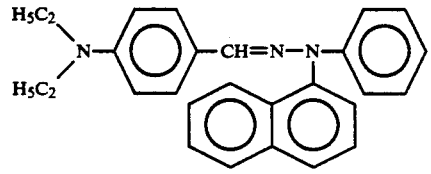

The coating liquid thus-prepared was applied to the surface of the base by the spray method so that a photosensitive layer the thickness of which was 20 μm was formed.

Then, a protection layer the thickness of which was 1.0 μm was formed on the photosensitive layer by a method similar to Example 1-1 before the durability test was performed. The results are shown in Table 1-1.

EXAMPLE 1-10

A photosensitive member constituted similarly to that according to Example 1-1 was manufactured except for the arrangements made such that the sequential order of constituting the charge generating layer and the charge transporting layer according to Example 1-1 was inverted. Then, the durability test was performed similarly to Example 1-1. The results are shown in Table 1-1. The thickness of the employed protection layer was 0.9 μm.

EXAMPLE 1-11

An aluminum cylinder the outer diameter of which was 80 mm and the length of which was 360 mm was used as the base. Then, a 5% methanol solution alkoxymethylated nylon according to Example 1-1 was applied to the base so that an undercoat layer (intermediate layer) having a thickness of 1 μm was formed.

Then, 10 parts by weight of crystalline type oxytitanium phthalocyanine of a type that the black angle $2\theta \pm 0.2°$ in the X-ray diffraction of Cu-Ka rays has strong peaks at 9.0°, 23.9° and 27.1°, 8 parts by weight of polyvinylbutylal and 50 parts by weight of cyclohexane were mixed and dispersed in a sand mill apparatus which used 100 parts by weight of glass beads the diameter of which was 1 mm for 20 hours.

Then, 70 to 120 parts by weight (a proper quantity) was added to the dispersed liquid thus-prepared before the mixed liquid was applied to the undercoat layer. Then, drying for 5 minutes was performed so that a charge generating layer the thickness of which was 0.2 μm was formed.

Then, 10 parts by weight of styryl compound and 10 parts by weight of bisphenol Z-type polycarbonate according to Example 1-1 were dissolved in 65 parts by weight of monochlorobenzene, the constitutional formula of the styryl compound being expressed as follows:

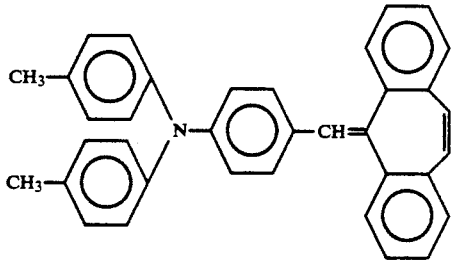

The solution thus-prepared was applied to the surface of the base by the dipping method before drying with hot air at 120° C. was performed for 60 minutes so that a charte transporting layer the thickness of which was 20 μm was formed.

Then, a protection layer the thickness of which was 1.0 μm was formed on the above-described charge transporting layer by the following method. The, 100 parts by weight of high-melting point polybutylene terephthalate (PBT) (A) (the limit viscosity was 0.72 dl/g, the melting point was 224° C. and the glass transition temperature was 35° C.) obtained by using 1,4-tetramethylene glycol serving as the glycol component and 30 parts by weight of the epoxy resin (B) according to Example 1-1 were dissolved in 100 ml mixture liquid of phenol and tetrachloroethane (1:1). Then, 3 parts by weight of triphenylsulfonium hexafluoroanthimonate (C) serving as the photopolymerization initiator and 0.6 parts by weight of triphenylated phosphorus serving as the antioxidant were added to that a resin composition solution was prepared.

The light irradiation conditions were arranged in such a manner that a 2 kw high pressure mercury lamp (30 w/cm) was disposed at a distance of 20 cm to irradiate at 130° C. for 8 seconds to harden the subject.

The photosensitive drum thus-manufactured was mounted on a copying machine (trade name: NP-3525 manufactured by Canon, Inc.) before the six hundred thousand durability test was performed similarly to Example 1-1. The results are shown in Table 1-2.

COMPARATIVE EXAMPLE 1-4

A photosensitive member constituted similarly to that according to Example 1-11 was manufactured except for the arrangement made such that the protection layer according to Example 1-11 was not used. Then, the durability test was performed similarly to Example 1-1. The results are shown in Table 1-2.

COMPARATIVE EXAMPLE 1-5

As a binder for use in the charge transporting layer (CTL) as an alternative to the protection layer according to Example 1-11, 4 parts by weight of bisphenol Z-type polycarbonate according to Example 1-1, 70 parts by weight of monochlorobenzene and 1 part by weight of PTFE fine powder were mixed and dispersed in a sand mill for 10 hours. As a result, coating liquid was prepared, the liquid being then applied to the surface of the CTL by the spray method by a thickness of 1.0 μm so that a protection layer was formed. Then, the durability test was performed by a method similar to Example 1-11. The results are shown in Table 1-2.

COMPARATIVE EXAMPLE 1-6

Coating liquid was re-prepared and so as to make the thickness of the protection layer according to Comparative Example 1-5 to be 12.0 μm before it was applied by spraying so that a protection layer the thickness of which was 12.0 μm was formed.

The photosensitive drum thus-manufactured was mounted on a copying machine (trade name: NP-3525 manufactured by Canon Inc.) before the six hundred thousand durability test was performed similarly to Example 1-11. The results are shown in Table 1-2.

COMPARATIVE EXAMPLE 1-7

A photosensitive drum arranged similarly to Example 1-1 was manufactured except for arrangements in that a polyester resin (Byron 200 manufactured by Toyo Boseki) the softening point of which was 163° C. (which has no melting point because it was amorphous material) was used in place of the high-melting point polyethylene terephthalate according to Example 1-1 and no antioxidant was used. The characteristics of the photosensitive drum thus-manufactured were evaluated. The results are shown in Table 1-1.

EXAMPLE 1-12

A test was performed similarly to Example 1-11 except for the arrangements made that a high-melting point polycyclohexane dimethylene terephthalate (PCT) resin (limit viscosity: 0.66 dl/g, the melting point: 290° C., glass transition temperature: 80° C.) prepared by using terephthalic acid as the acid component and cyclohexane dimethylol as the glycol component was used and 1.2 parts by weight of N-phenyl-N'-isopropyl-P-phenylenediamine was employed as the antioxidant. The results are shown in Table 1-2.

EXAMPLE 1-13

A test was performed similarly to Example 1-11 except for the arrangement made that a high-melting point polyethylene napthalate resin (PEN) (limit viscosity: 0.69 dl/g, the melting point: 280° C., glass transition temperature: 85° C.) prepared by using 1,10-naphthalenedicarbonic acid as the acid component and ethylene glycol as the glycol component was used. The results are shown in Table 1-2.

EXAMPLE 1-14

A test was performed similarly to Example 1-11 except for the arrangements made that a high-melting point polyester resin (limit viscosity: 0.67 dl/g, the melting point: 190° C., glass transition temperature: 15° C.) prepared by using a mixture of terephthalic acid as the acid component and 63 mol % 1,4-tetramethylene glycol and 37 mol % polyethylene glycol as the glycol components was used. The results are shown in Table 1-2.

EXAMPLE 1-15

A test was performed similarly to Example 1-11 except for the arrangements made that an epoxy resin according to Example 1-6 was used as the cured resin. The results are shown in Table 1-2.

EXAMPLE 1-16

A photosensitive member arranged similarly to Example 1-11 was manufactured except for an arrangement made that the quantity of the epoxy resin according to Example 1-11 was made to be 10 parts by weight. Then, the durability test was performed. The results are shown in Table 1-2. The thickness of the protection layer was 0.9 μm.

EXAMPLE 1-17

A photosensitive member constituted similarly to that according to Example 1-11 was manufactured except for the arrangement made that the high pressure mercury lamp according to Example 1-11 was turned on for 5 seconds. Then, the durability test was performed. The results are shown in Table 1-2. The thickness of the protection layer was 1.0 μm.

EXAMPLE 1-18

An aluminum cylinder the outer diameter of which was 80 mm and the length of which was 360 mm was used as the base. Then, 5% methanol solution of alkoxymethylated nylon according to Example 1-11 was applied to the base by the dipping method so that an undercoat layer (intermediate layer) the thickness of which was 1 μm was formed. Then, 3 parts by weight of pigment according to Example 1-11 and serving as the charge generating material, 6 parts by weight of stryl compound serving as the charge transporting material and according to Example 1-1, 6 parts by weight of bisphenol Z-type polycarbonate according to Example 1-11 and 50 parts by weight of monochlorobenzene were mixed and dispersed in a sand mill for 30 hours. As a result, coating liquid was prepared which was then applied by the spray method so that a photosensitive layer having a thickness of 20 μm was formed.

Then, a protection layer having a thickness of 1.0 μm was formed on the above-described photosensitive layer by a method similar to that according to Example 1-11. Then, the durability test was performed similarly. The results are shown in Table 1-2.

EXAMPLE 1-19

The photosensitive member constituted similarly to Example 1-11 was manufactured except for an arrangement made such that the sequential order of constituting the charge generating layer and the charge transporting layer according to Example 1-11 was inverted. Then, the durability test was performed. The results are shown in Table 1-2. The thickness of the protection layer was 0.8 μm.

EXAMPLE 1-20

The photosensitive member constituted similarly to that according to Example 1-11 was manufactured except for an arrangement made such that 100 ml hexafluoroisopropanol was used in place of 100 ml of mixture liquid of phenol and tetrachloroethane (1:1) according Example 1-11. Then, the durability test was performed similarly to Example 1-11. The results are shown in Table 1-2.

EXAMPLES 1-21 and 1-22

The photosensitive member according to Example 1-11 and that according to Example 1-20 were subjected to 100,000-sheet durability test similarly to Example 1-11 by using a copying machine [Trade name: NP-3525 (manufactured by Canon Inc.)] in an environment where the temperature was 30° C. and the relative humidity was 85%. The results are shown in Table 1-2.

TABLE 1-1

| | Initial Characteristics | | | | Characteristics After Durability Test | | | | | | |
|---|---|---|---|---|---|---|---|---|---|---|---|
| Example No. | Vd (−V) | Vl (−V) | Vr (−V) | Quality of Image | Vd (−V) | Vl (−V) | Vr (−V) | Quality of Image | Quantity Scrapted (μm) | Number of Sheets (× 10,000 sheets) | Remarks |
| 1-1 | 710 | 145 | 20 | good | 700 | 150 | 25 | good | 0.1 | 60 | No Problem |
| 1-2 | 700 | 140 | 20 | good | 700 | 145 | 25 | good | 0.2 | 60 | No Problem |
| 1-3 | 710 | 155 | 25 | good | 700 | 160 | 25 | good | 0.3 | 60 | No Problem |
| 1-4 | 715 | 145 | 20 | good | 710 | 155 | 30 | good | 0.4 | 60 | No Problem |
| 1-5 | 710 | 140 | 20 | good | 700 | 145 | 20 | good | 0.6 | 60 | No Problem |
| 1-6 | 710 | 145 | 20 | good | 700 | 160 | 25 | good | 0.3 | 60 | No Problem |
| 1-7 | 695 | 150 | 20 | good | 690 | 160 | 30 | good | 0.3 | 60 | No Problem |
| 1-8 | 700 | 155 | 30 | good | 715 | 160 | 30 | good | 0.2 | 60 | No Problem |
| 1-9 | −700 | −170 | −25 | good | −705 | −175 | −35 | good | 0.2 | 60 | No Problem |
| 1-10 | −700 | −150 | −75 | good | −675 | −160 | −90 | good | 0.2 | 60 | No Problem |

TABLE 1-1-continued

| Example No. | Initial Characteristics Vd (−V) | Vl (−V) | Vr (−V) | Quality of Image | Characteristics After Durability Test Vd (−V) | Vl (−V) | Vr (−V) | Quality of Image | Quantity Scrapted (μm) | Number of Sheets (× 10,000 sheets) | Remarks |
|---|---|---|---|---|---|---|---|---|---|---|---|
| Comparative Example 1-1 | 700 | 145 | 15 | good | 460 | 200 | 95 | No Good | 12.6 | 6 | White portion generated in this side of image at 60000 sheets and the durability test was stopped |
| Comparative Example 1-2 | 700 | 195 | 45 | good | 470 | 205 | 85 | No Good | 11.2 | 11 | White portion generated in this side of image at 110,000 sheets and the durability test was stopped |
| 1-3 | 710 | 135 | 10 | good | 770 | 530 | 490 | No Good | 0.6 | 0.2 | Black line generated at about 1000 sheets and base fogging became excessive at 2000 sheets and the durability test was stopped |
| Comparative Example 1-7 | 700 | 145 | 20 | good | 450 | 190 | 80 | No Good | 10.9 | 8 | White portion generated in this side of image at 80000 sheets and the durability test was stopped |

Note 1) Vd: potential of dark portion, Vl: potential of bright portion (luminance 3 lux.sec), Vr: residual potential
Note 2) The charged polarity of − of Example 9 is changed to + in Example 10

TABLE 1-2

| Example No. | Initial Characteristics Vd (−V) | Vl (−V) | Vr (−V) | Quality of Image | Characteristics After Durability Test Vd (−V) | Vl (−V) | Vr (−V) | Quality of Image | Quantity Scrapted (μm) | Number of Sheets (× 10,000 sheets) | Remarks |
|---|---|---|---|---|---|---|---|---|---|---|---|
| 1-11 | 700 | 150 | 10 | good | 695 | 145 | 20 | good | 0.2 | 60 | No Problem |
| 1-12 | 700 | 145 | 20 | good | 705 | 140 | 25 | good | 0.2 | 60 | No Problem |
| 1-13 | 710 | 150 | 20 | good | 710 | 150 | 30 | good | 0.3 | 60 | No Problem |
| 1-14 | 710 | 145 | 20 | good | 705 | 150 | 30 | good | 0.4 | 60 | No Problem |
| 1-15 | 705 | 155 | 20 | good | 705 | 155 | 25 | good | 0.3 | 60 | No Problem |
| 1-16 | 700 | 150 | 20 | good | 700 | 155 | 30 | good | 0.2 | 60 | No Problem |
| 1-17 | 705 | 145 | 20 | good | 705 | 150 | 30 | good | 0.2 | 60 | No Problem |
| 1-18 | −700 | −155 | −20 | good | −710 | −160 | −30 | good | 0.1 | 60 | No Problem |
| 1-19 | −700 | −160 | −50 | good | −680 | −170 | −75 | good | 0.2 | 60 | No Problem |
| 1-20 | 700 | 130 | 20 | good | 695 | 140 | 15 | good | 0.2 | 60 | No Problem |
| 1-21 | 710 | 135 | 15 | good | 700 | 155 | 30 | good | <0.1 | 10 | No Problem |
| 1-22 | 700 | 125 | 15 | good | 700 | 130 | 20 | good | <0.1 | 10 | No Problem |
| Comparative Example 1-4 | 700 | 145 | 15 | good | 460 | 200 | 95 | No Good | 12.6 | 6 | White portion generated in this side of image at 60,000 sheets and the durability test was stopped |
| 1-5 | 700 | 195 | 45 | good | 470 | 205 | 85 | No Good | 11.2 | 11 | White portion generated in this side of image at 110,000 sheets and the durability test was stopped |
| Comparative Example 1-6 | 710 | 135 | 10 | good | 770 | 530 | 490 | No Good | 0.6 | 0.2 | Black line generated at about 1000 sheets and base fogging became |

TABLE 1-2-continued

| Example No. | Initial Characteristics Vd (−V) | Vl (−V) | Vr (−V) | Quality of Image | Characteristics After Durability Test Vd (−V) | Vl (−V) | Vr (−V) | Quality of Image | Quantity Scrapted (μm) | Number of Sheets (× 10,000 sheets) | Remarks |
|---|---|---|---|---|---|---|---|---|---|---|---|
| | | | | | | | | | | | excessive at 2000 sheets and the durability test was stopped |

Note 1) Vd: potential of dark portion, Vl: potential of bright portion (luminance 3 lux.sec), Vr: residual potential
Note 2) The charged polarity of − of Example 9 is changed to + in Example 10
Examples 21 and 22 were tested at temperature of 30° C. and relative humidity of 85%

An aluminum cylinder arranged such that the outer diameter was 80 mm and the length was 360 mm was used as the base before 5% methanol solution of alkoxymethyl nylon was applied to the base by a dipping method so that an undercoat layer (intermediate layer) the thickness of which was 1 μm was formed.

Then, 10 parts of a pigment the constitutional formula of which was expressed as follows, 8 parts of polyvinylbutyral and 50 parts of cyclohexanone were mixed and dispersed for 20 hours in a sand mill apparatus which accommodated 100 parts of glass beads the diameter of each of which was 1 mm:

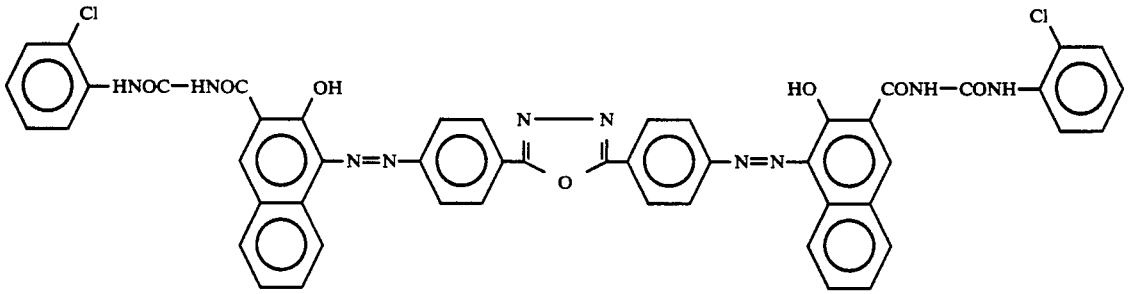

The dispersed liquid thus-prepared was applied to the surface of the undercoat layer after 70 to 120 (a proper quantity) parts of methylethylketone had been added to the dispersed liquid before drying was performed at 100° C. for 5 minutes so that a charge generating layer (CGL) the thickness of which was 0.2 μm was formed. Then, 130 parts by weight of hydrazone was mixed and dissolved into resin liquid prepared by the following method (by a mixture ration between hydrazone and the resin component was 1:1) so that coating liquid was prepared, the constitutional formula of hydrazone being expressed as follows:

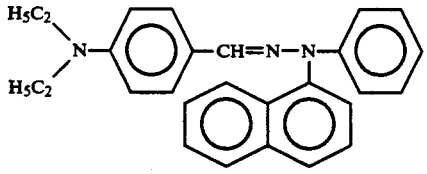

The coating liquid thus-prepared was applied on the charge generating layer by the dipping method before light was applied so that a charge transporting layer (CTL) the thickness of which was 20 mm was formed.

The resin liquid was prepared in such a manner that 100 parts by weight of high-melting point polyethylene terephthalate (A)(the limit viscosity was 0.70 dl/g, the melting point was 258° C. and the glass transition temperature was 70° C.) prepared by using terephthalic acid as the acid component and ethylene glycol as the glycol component and 30 parts by weight of an epoxy resin [aromatic ester type resin having an epoxy equivalence of 160 and trade name of Epicoat 190P (manufactured by Oil Shell Epoxy) were dissolved in 100 ml mixture liquid of phenol and tetrachloroethane (1:1).

Then, 3 parts by weight of triphenylsulfonium hexafluoroanthimonate (C) were added as the photopolymerization initiator before 0.1 parts by weight of the resin composition solution was prepared.

The above-described coating liquid was applied to the surface of the charge generating layer by the dipping method before it was irradiated with light so that a charge transporting layer (CTL) having a thickness of 20 μm was formed.

The light irradiation conditions for curing the sample were made in such a manner that a 2 kw high pressure mercury lamp (30 w/cm) was disposed at a distance of 20 cm to irradiate the subject at 130° C. for 8 seconds.

The photosensitive drum thus-manufactured was mounted on a copying machine [Trade name: NP-3525 (manufactured by Canon Inc.] Then, a durability test in which six hundred thousand paper sheets durability was evaluated at a temperature of 24° C. and the relative humidity of 55%. The results are shown in Table 1-1.

EXAMPLE 2-2

A test was performed similarly to Example 2-1 except for the arrangements made that a high-melting point polyester resin (limit viscosity: 0.68 dl/g, the melting point: 210° C., glass transition temperature: 68° C.) prepared by using terephthalic acid as the acid component, 80 mol % ethylene glycol and 20 mol % polyethylene glycol [the molecular weight: 1000] as the glycol components was used, 0.2 parts by weight antioxidant according to Example 1-2 was employed and 3 parts by weight of silicon type comb type graft polymer according to Example 1-2 were added. The results are shown in Table 2-1.

EXAMPLE 2-3

A test was performed similarly to Example 2-1 except for the arrangements made that a high-melting point polyester resin (limit viscosity: 0.67 dl/g, the melting point: 195° C., glass transition temperature: 65° C.) prepared by using terephthalic acid as the acid component, 63 mol % ethylene glycol and 37 mol % polyethylene glycol [the molecular weight: 1000] as the glycol components was used and 0.3 parts by weight of the antioxidant according to Example 1-3 was used. The results are shown in Table 21.

EXAMPLE 2-4

A test was performed similarly to Example 2-2 except for the arrangements made that a high-melting point polyester resin (limit viscosity: 0.66 dl/g, the melting point: 180° C., glass transition temperature: 64° C.) prepared by using terephthalic acid as the acid component, 50 mol % ethylene glycol and 50 mol % polyethylene glycol [the molecular weight: 1000] as the glycol components was used and 0.2 parts by weight of the antioxidant according to Example 1-4 was used. The results are shown in Table 2-1.

EXAMPLE 2-5

A test was performed similarly to Example 2-1 except for the arrangements made that a high-melting point polyester resin (limit viscosity: 0.64 dl/g, the melting point: 161° C., glass transition temperature: 60° C.) prepared by using terephthalic acid as the acid component, 40 mol % ethylene glycol and 60 mol % polyethylene glycol [the molecular weight: 1000] as the glycol components was used, 0.5 parts by weight of antioxidant according to Example 1-5 was employed and 3 parts by weight of silicon type comb type graft polymer according to Example 1-5 were added. The results are shown in Table 2-1.

EXAMPLE 2-6

A test was performed similarly to Example 2-1 except for arrangements made such that an epoxy resin [a bisphenol type resin having an epoxy equivalence of 184 to 194 and trade name of which was Epicoat 828 (manufactured by Oil Shell Epoxy) and 1 part by weight of the antioxidant according to Example 1-6 were used. The results are shown in Table 2-1.

COMPARATIVE EXAMPLE 2-1

The charge transporting layer was formed by using 130 parts by weight of bisphenol type polycarbonate and 900 parts by weight of monochlorobenzene in place of the resin liquid for the charge transporting layer according to Example 2-1. Then, the durability test was performed similarly to Example 2-1. The results are shown in Table 2-1.

COMPARATIVE EXAMPLE 2-2

A protection layer using known PTFE powder for the purpose of improving the durability of the photosensitive member according to Comparative Example 2-1 was formed as follows before the durability test was performed. The results are as shown in Table 2-1.

The protection layer was formed in such a manner that a coating liquid was prepared by mixing and dispersing 4 parts by weight of the above-described bisphenol Z-type polycarbonate, 70 parts by weight of monochlorobenzene and 1 part by weight of PTFE powder. The liquid thus-prepared was applied to the CTL by the spray method by a thickness of 1.0 μm so that the protection layer was formed.

COMPARATIVE EXAMPLE 2-3

Coating liquid was re-prepared in such a manner that the thickness of the protection layer according to Comparative Example 2-2 was made to be 12.0 μm before it was applied by spraying. As a result, a protection layer having a thickness of 12.0 μm was formed before the durability test was performed. The results are shown in Table 2-1.

COMPARATIVE EXAMPLE 2-4

A photosensitive drum arranged similarly to Example 2-1 was manufactured except for arrangements in that a polyester resin (Byron 200 manufactured by Toyo Boseki) the softening point of which was 163° C. (which has no melting point because it was amorphous material) was used in place of the high-melting point polyethylene terephthalate according to Example 2-1 and no antioxidant was used. The characteristics of the photosensitive drum thus-manufactured were evaluated. The results are shown in Table 2-1.

EXAMPLE 2-7

An aluminum cylinder the outer diameter of which was 80 mm and the length of which was 360 mm was made to be the base. Then, 5% methanol solution of alkoxymethylated nylon according to Example 2-1 was applied to the base by the dipping method so that an undercoat layer (intermediate layer) the thickness of which was 1 μm was formed. Then, 10 parts of styryl compound and 10 parts of polymethylmethacrylate were dissolved in 65 parts by weight THF, the constitutional formula of the styryl compound being expressed as follows:

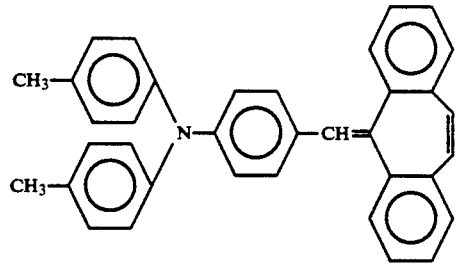

The solution thus-prepared was applied to the above-described intermediate layer by the dipping method before it was heated at 125° C. for 70 minutes with hot air so that a charge transporting layer the thickness of which was 15 μm was formed.

Then, 10 parts by weight of pigment and resin liquid which corresponds to 7 parts by weight of resin of the charge transporting layer according to Example 2-1 were added, the constitutional formula of the pigment being expressed as follows:

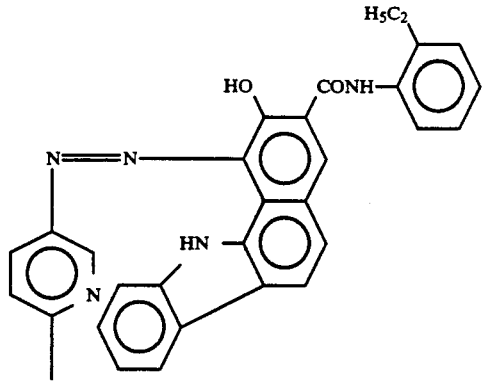

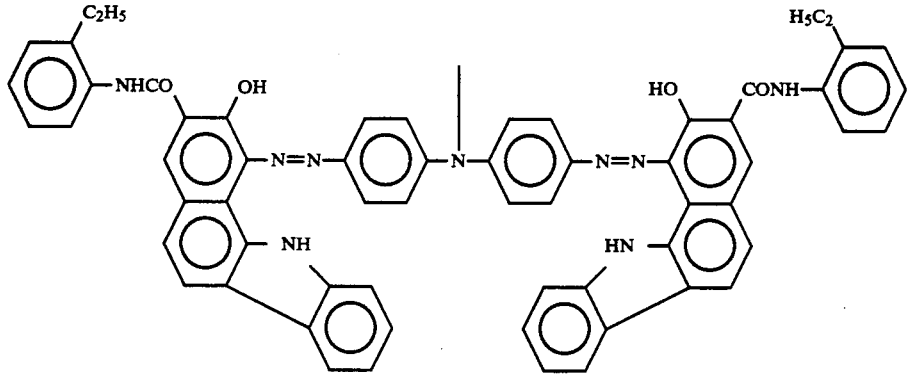

Then, they were mixed and dispersed for 20 hours by a sand mill so that liquid to be applied to the charge transporting layer was prepared. The liquid was used to form a charge generating layer the thickness of which was 0.8 mm. Then, the durability test was performed. The results are shown in Table 2-1.

EXAMPLE 2-8 an aluminum cylinder the outer diameter of which was 80 mm and length of which was 360 mm was used as the base and 5% methanol solution of alkoxymethylated nylon according to Example 2-1 was applied to the base by the dipping method. As a result, an undercoat layer (intermediate layer) the thickness of which was 1 μm was formed.

Then, 3 parts by weight of ϵ-type Cu-PC serving as the charge generating material, 6 parts by weight of the hydrazone compound according to Embodiment 2-1 and resin liquid which corresponds to 10 parts by weight of resin of the charge transporting layer according to Example 2-1 were added before they were mixed and dispersed for 30 hours by a sand mill. As a result, coating liquid was prepared, the liquid being then used to form the photosensitive layer the thickness of which was 18 μm. Then, the durability test was performed. The results are shown in Table 2-1.

EXAMPLE 2-9

The photosensitive member constituted similarly to Example 2-1 except for the arrangement made such that the quantity of the expoxy resin according to Example 2-1 was changed to 10 parts was manufactured. Then, the durability test was performed. The results are shown in Table 2-1.

EXAMPLE 2-10

The photosensitive member constituted similarly to Example 2-1 except for the arrangement made such that the high pressure mercury lamp according to Example 2-1 was used for 6 seconds was manufactured. The, the durability test was performed. The results are shown in Table 2-1.

EXAMPLE 2-11

An aluminum cylinder the outer diameter of which was 80 mm and the length of which was 360 mm was used as the base. Then, 5% methanol solution of alkoxymethylated nylon according to Example 2-1 was applied to the base by the dipping method. As a result, an undercoat layer (intermediate layer) the thickness of which was 1 μm was formed.

Then, 10 parts by weight of the pigment the constitutional formula was expressed by 2-(1), 8 parts by weight of polyvinyl butyral and 50 parts by weight of cyclohexane were mixed and dispersed by a sand mill apparatus which contains 100 parts by weight of glass beads the diameter of each of which was 1 mm for 20 hours. Then, 70 to 120 parts (a proper quantity) of methylethyl ketone was added to the dispersion liquid thus-prepared before they were applied to the undercoat layer. Then, its was dried at 100° C. for 5 minutes so that a charge generating layer (CGL) the thickness of which was 0.2 μm was formed. Then, 130 parts by weight of hydrazone according to Example 2-1 was mixed and dissolved in resin liquid prepared by the following method. As a result, liquid to be applied to the charge generating layer was prepared. The coating liquid was applied to the charge generating layer before it was irradiated with light. As a result, a charge generating layer (CTL) the thickness of which was 20 μm was formed.

The resin liquid was prepared in such a manner that 100 parts by weight of high-melting point polybutylene terephthalate (PBT) (A)(the limit viscosity was 0.72 dl/g, the melting point was 224° C. and the glass transition temperature was 35° C.) prepared by using terephthalic acid as the acid component and 1,4-tetramethylene glycol (1,4-buthanediol) as the glycol component and 30 parts by weight of the epoxy resin (B) according to Example 2-1 were dissolved in 100 ml mixture liquid of phenol and tetrachloroethane (1:1).

Then, 3 parts by weight of triphenylsulfonium hexafluoroanthimonate (C) was used as the photopolymerization initiator and 0.6 parts by weight of the oxidation initiator according to Example 1-11 were further added. As a result, a resin composition solution was prepared.

The coating liquid thus-prepared was applied to the charge generating layer by the dipping method. As a result, a charge transporting layer (CTL) the thickness of which was 20 μm was formed.

The light irradiation conditions for curing the sample were made in such a manner that a 2 kw high pressure mercury lamp (30 w/cm) was disposed at a distance of 20 cm to irradiate the subject at 130° C. for 8 seconds.

The photosensitive drum thus-manufactured was mounted on a copying machine [Trade name: NP-3525 (manufactured by Canon Inc.] Then, a durability test in which six hundred thousand paper sheets durability was evaluated at a temperature of 24° C. and the relative humidity of 55%. The results are shown in Table 2-2.

EXAMPLE 2-12

A test was performed similarly to Example 2-11 except for the arrangements made that a high-melting point polycyclohexane dimethylene terephthalate [(PCT), limit viscosity: 0.66 dl/g, the melting point: 290° C., glass transition temperature: 80° C.) prepared by using terephthalic acid as the acid component and cyclohexane dimethylol as the glycol components was used and 1.2 parts by weight of antioxidant according to Example 1-12 was used as the antioxidant. The results are shown in Table 2-2.

EXAMPLE 2-13

A test was performed similarly to Example 2-11 except for the arrangement made that a high-melting point polyethylene naphthalate resin (PEN) (limit viscosity: 0.69 dl/g, the melting point: 280° C., glass transition temperature: 85° C.) prepared by using 1,10-naphthalenedicarbonic acid as the acid component and ethylene glycol as the glycol component was used. The results are shown in Table 2-2.

EXAMPLE 2-14

A test was performed similarly to Example 2-11 except for the arrangements made that a high-melting point polyester resin (limit viscosity: 0.67 gl/g, the melting point: 190° C., glass transition temperature: 15° C. prepared by using terephthalic acid as the acid component, 63 mol % 1,4-tetramethylene glycol and 27 mol % polyethylene glycol [the molecular weight: 1000] as the glycol components was used. The results are shown in Table 2-2.

EXAMPLE 2-15

A test was performed similarly to Example 2-11 except for the arrangement made that the epoxy rein according to Example 2-6 was used as the cured resin. The results are shown in Table 2-2.

EXAMPLE 2-16

An aluminum cylinder the outer diameter of which was 80 mm and the length of which was 360 mm was used as the base. Then, 5% methanol solution of alkoxymethylated nylon according to Example 2-11 was applied to the base by the dipping method. As a result, an undercoat layer (intermediate layer) having a thickness of 1 μ, was formed. Then, 10 parts by weight of styryl compound according to Example 2-7 and 10 parts by weight of polymethylmethacrylate according to Example 2-7 were dissolved in 65 parts by weight of THF. The solution thus-prepared was applied to the intermediate layer before it was heated at 125° C. for 70 minutes with hot air. As a result, a charge transporting layer having a thickness of 15 μm was formed.

Then, 10 parts by weight of pigment according to Example 2-7 and resin liquid which corresponds to 7 parts by weight of the resin of the charge transporting layer according to Example 2-11 were added before they were mixed and dispersed by a sand mill for 20 hours. As a result coating liquid was prepared. Then, a charge generating layer having a thickness of 0.8 mm was prepared by using the above-described coating liquid. Then, the durability test was performed. The results are shown in Table 2-2.

EXAMPLE 2-17

An aluminum cylinder the outer diameter of which was 80 mm and the length of which was 360 mm was used as the base. Then, 5% methanol solution of alcoxymethylated nylon according to Example 2-11 was applied to the base by the dipping method. As a result, an undercoat layer (intermediate layer) having a thickness of 1 μm was formed.

Then, 3 parts by weight of ϵ-type Cu-PC serving as the charge generating material, 6 parts by weight of the hydrazone compound serving as the charge transporting material and according to Example 2-1 and resin liquid which corresponds to 10 parts by weight of resin of the charge transporting layer according to Example 2-11 were added. Then, they were mixed and dispersed by a sand mill for 30 hours. As a result, coating liquid was prepared. Then, a photosensitive layer having a thickness of 18 μm was formed by using the above-described coating liquid before the durability test was performed. The results are shown in Table 2-2.

EXAMPLE 2-18

The photosensitive member constituted similarly to Example 2-11 was manufactured except for an arrangement made that the quantity of the epoxy resin according to Example 2-11 was made to be 10 parts. Then, the durability test was performed. The results are shown in Table 2-2.

EXAMPLE 2-19

The photosensitive member constituted similarly to Example 2-11 was manufactured except for an arrangement made that the high pressure mercury lamp according to Example 2-11 was applied for 6 seconds. Then, the durability test was performed. The results are shown in Table 2-2.

EXAMPLE 2-20

The photosensitive member constituted similarly to Example 2-11 was manufactured except for an arrangement made that 100 ml hexafluoroisopropanol was used in place of 100 ml mixed liquid of phenol and tetrachloroethane (1:1) according to Example 2-11. Then, the durability test was performed. The results are shown in Table 2-2.

on a copying machine [Trade Name: NP-3525 (manufactured by Canon Inc.)]. Then, a 100,000 paper sheets durability test was performed at environmental conditions at 30° C. and 85% of relative humidity was performed. The results are shown in Table 2-2.

TABLE 2-1

| | Initial Characteristics | | | | Characteristics After Durability Test | | | | | | |
|---|---|---|---|---|---|---|---|---|---|---|---|
| Example No. | Vd (−V) | Vl (−V) | Vr (−V) | Quality of Image | Vd (−V) | Vl (−V) | Vr (−V) | Quality of Image | Quantity Scrapted (μm) | Number of Sheets (× 10,000 sheets) | Remarks |
| 2-1 | 710 | 130 | 20 | good | 700 | 140 | 25 | good | 0.4 | 60 | No Problem |
| 2-2 | 700 | 120 | 25 | good | 700 | 140 | 30 | good | 0.3 | 60 | No Problem |
| 2-3 | 700 | 120 | 20 | good | 700 | 135 | 25 | good | 0.8 | 60 | No Problem |
| 2-4 | 710 | 125 | 15 | good | 700 | 140 | 30 | good | 0.7 | 60 | No Problem |
| 2-5 | 700 | 130 | 20 | good | 690 | 150 | 20 | good | 0.9 | 60 | No Problem |
| 2-6 | 700 | 135 | 25 | good | 700 | 140 | 40 | good | 0.5 | 60 | No Problem |
| 2-7 | −700 | −140 | −30 | good | −680 | −150 | −35 | good | 0.4 | 60 | No Problem |
| 2-8 | −700 | −150 | −30 | good | −710 | −150 | −40 | good | 0.4 | 60 | No Problem |
| 2-9 | 710 | 145 | 30 | good | 700 | 150 | 40 | good | 0.7 | 60 | No Problem |
| 2-10 | 700 | 130 | 20 | good | 710 | 155 | 20 | good | 0.8 | 60 | No Problem |
| Comparative Example 2-1 | 700 | 145 | 15 | good | 460 | 200 | 95 | No Good | 12.6 | 6 | White portion generated in this side of image at 60000 sheets and the durability test was stopped |
| Comparative Example 2-2 | 700 | 195 | 45 | good | 470 | 205 | 85 | No Good | 11.2 | 11 | White portion generated in this side of image at 110,000 sheets and the durability test was stopped |
| 2-3 | 710 | 140 | 25 | good | 730 | 480 | 420 | No Good | 0.6 | 0.2 | Black line generated at about 1000 sheets and base fogging became excessive at 2000 sheets and the durability test was stopped |
| Comparative Example 2-4 | 700 | 140 | 20 | good | 460 | 195 | 85 | No Good | 11.4 | 9 | White portion generated in this side of image at 90000 sheets and the durability test was stopped |

Note 1) Vd: potential of dark portion, Vl: potential of bright portion (luminance 3 lux.sec), Vr: residual potential
Note 2) The charged polarity of − of Example 7 is changed to + in Example 8

EXAMPLES 2-21 AND 2-22

The photosensitive member according to Example 2-11 and that according to Example 2-20 were mounted

TABLE 2-2

| | Initial Characteristics | | | | Characteristics After Durability Test | | | | | | |
|---|---|---|---|---|---|---|---|---|---|---|---|
| Example No. | Vd (−V) | Vl (−V) | Vr (−V) | Quality of Image | Vd (−V) | Vl (−V) | Vr (−V) | Quality of Image | Quantity Scrapted (μm) | Number of Sheets (× 10,000 sheets) | Remarks |
| 2-11 | 700 | 135 | 20 | good | 700 | 150 | 25 | good | 0.3 | 60 | No Problem |
| 2-12 | 710 | 120 | 25 | good | 710 | 150 | 30 | good | 0.3 | 60 | No Problem |
| 2-13 | 710 | 140 | 30 | good | 700 | 145 | 30 | good | 0.3 | 60 | No Problem |
| 2-14 | 700 | 140 | 25 | good | 700 | 150 | 30 | good | 0.7 | 60 | No Problem |
| 2-15 | 710 | 140 | 20 | good | 710 | 140 | 25 | good | 0.6 | 60 | No Problem |
| 2-16 | −700 | −150 | −40 | good | −690 | −145 | −30 | good | 0.4 | 60 | No Problem |
| 2-17 | −710 | −150 | −45 | good | −710 | −160 | −40 | good | 0.4 | 60 | No Problem |
| 2-18 | 700 | 150 | 30 | good | 700 | 150 | 30 | good | 0.6 | 60 | No Problem |
| 2-19 | 710 | 140 | 30 | good | 700 | 145 | 20 | good | 0.5 | 60 | No Problem |
| 2-20 | 700 | 130 | 10 | good | 690 | 120 | 15 | good | 0.4 | 60 | No Problem |
| 2-21 | 700 | 120 | 20 | good | 700 | 190 | 80 | good | <0.1 | 10 | No Problem |
| 2-22 | 710 | 120 | 15 | good | 700 | 125 | 20 | good | <0.1 | 10 | No Problem |

Note 1) Vd: potential of dark portion, Vl: potential of bright portion (luminance 3 lux.sec), Vr: residual potential
Note 2) The charged polarity of − of Example 16 is changed to + in Example 17

Although the invention has been described in its preferred form with a certain degree of particularity it is understood that the present disclosure of the preferred form can be changed in the details of construction and different combination and arrangement of parts may be resorted to without departing from the spirit and the scope of the invention as hereinafter claimed.

What is claimed is:

1. An image bearing member having a surface layer comprising a high melting point polyester resin having a melting point of at least 160° C., a cured resin and an antioxidant.

2. An image bearing member according to claim 1, wherein said cured resin is present in amounts of 3 to 50 parts by weight with respect to 100 parts by weight of said high-melting point polyester resin.

3. An image bearing member according to claim 1, wherein said high-melting point polyester resin is a polyethylene terephthalate resin.

4. An image bearing member according to claim 1, wherein said high-melting point polyester resin is a polybutylene terephthalate resin.

5. An image bearing member according to claim 1, wherein said high-melting point polyester rein is a polycyclohexane dimethylene terephthalate resin.

6. An image bearing member according to claim 1, wherein said high-melting point polyester resin is a polyethylene naphthalate resin.

7. An image bearing member according to claim 1, wherein said cured resin in a photoionically cured epoxy resin.

8. An image bearing member according to claim 1, wherein said surface layer is a protection layer.

9. An image bearing member according to claim 9, wherein the thickness of said protection layer is not greater than 3.0 μm.

10. An image bearing member according to claim 8 including at least said protection layer and a photoconductive layer.

11. An image bearing member according to claim 10 wherein said photoconductive layer is an organic photoconductive layer.

12. An image bearing member according to claim 11 wherein said organic photoconductive layer is a lamination body composed of a charge generating layer and a charge transporting layer.

13. An image bearing member according to claim 1 including an organic photoconductive layer and wherein said surface layer is a protection layer.

14. An image bearing member according to claim 1, wherein said surface layer is an organic photoconductive.

15. An image bearing member according to claim 14, wherein said organic photoconductive layer is a charge transporting layer.

16. An image bearing member according to claim 14, wherein said organic photoconductive layer is a charge generating layer.

17. An apparatus unit comprising:

charging means;

developing means; and cleaning means, wherein a single unit is formed of at least any one of said charging means, said developing means and said cleaning means which is integrally supported with an image bearing member having a surface layer comprising a high-melting point polyester resin having a melting point of at least 160° C., a photocured resin and an antioxidant, said single unit being detachable from the apparatus unit.

18. An apparatus unit according to claim 17, wherein said high-melting point polyester resin has a melting point of at least 160° C.

19. An apparatus unit according to claim 18, wherein said surface layer is a layer selected from a protection layer and an organic photoconductive layer.

20. An electrophotographic apparatus comprising:

an image bearing member having a surface layer comprising a high-melting point polyester resin having a melting point of at least 160° C., a photocured resin and an antioxidant;

latent image forming means;

means for developing a formed latent image; and means for transferring a developed image to a transfer member.

21. A facsimile machine comprising:

an electrophotographic apparatus including an image bearing member having a surface layer comprising a high melting point polyester resin having a melting point of at least 160° C., a photocured resin and an antioxidant, latent image forming means, means for developing a formed latent image and means for transferring a developed image to a transfer member; and receiving means for receiving image information supplied from a remote terminal.

* * * * *

UNITED STATES PATENT AND TRADEMARK OFFICE

CERTIFICATE OF CORRECTION

PATENT NO. : 5,292,603
DATED : March 8, 1994
INVENTOR(S) : KIYOSHI SAKAI, ET AL

It is certified that error appears in the above-indentified patent and that said Letters Patent is hereby corrected as shown below:

COLUMN 2

Line 4, "tone" should read --toner--.
Line 35, "by" should read --by a--.

COLUMN 3

Line 6, "the" should be deleted.
Line 13, "to" (second occurrence) should be deleted.

COLUMN 4

Line 39, "be" should be deleted.

COLUMN 5

Line 38, "member" should read --member,--.
Line 41, "organic" should read --inorganic--.
Line 66, "where" should read --of--.
Line 67, "and" should be deleted.

COLUMN 7

Line 20, "buthylene" should read --butylene--.

COLUMN 8

Line 21, "Ciba-Geigy." should read --Ciba-Geigy).--.

COLUMN 12

Line 16, "chlorohydroquenone," should read --chlorohydroquinone,--.

UNITED STATES PATENT AND TRADEMARK OFFICE

CERTIFICATE OF CORRECTION

PATENT NO. : 5,292,603

DATED : March 8, 1994

INVENTOR(S) Kiyoshi Sakai, et al

It is certified that error appears in the above-indentified patent and that said Letters Patent is hereby corrected as shown below:

COLUMN 13

Line 6, "high" should read --higher--.
Line 65, "quenone" should read --quinone--.

COLUMN 14

Line 3, "silicon" should read --silicon.--.
Line 41, "binder if necesary" should read --binder, if necessary,--.

COLUMN 18

Line 26, "weigh" should read --weight--.

COLUMN 19

Line 7, "weigh" should read --weight--.
Line 35, "point" should read --point:--.

UNITED STATES PATENT AND TRADEMARK OFFICE

CERTIFICATE OF CORRECTION

PATENT NO. : 5,292,603
DATED : March 8, 1994
INVENTOR(S) : KIYOSHI SAKAI, ET AL

It is certified that error appears in the above-indentified patent and that said Letters Patent is hereby corrected as shown below:

COLUMN 20

Line 15, "Oil Shell Epoxy]." should read --Shell Oil Epoxy].--.

COLUMN 21

Line 30, "9.0°, 23.9°" should read --9.0°, 14.2°, 23.9°--.
Line 63, "charte" should read --charge--.

COLUMN 22

Line 11, "to" should read --so--.

UNITED STATES PATENT AND TRADEMARK OFFICE

CERTIFICATE OF CORRECTION

PATENT NO. : 5,292,603

DATED : March 8, 1994

INVENTOR(S) : Kiyoshi Sakai, et al

It is certified that error appears in the above-indentified patent and that said Letters Patent is hereby corrected as shown below:

COLUMN 27

Line 45, "ration" should read --ratio--.

COLUMN 28

Line 15, "Oil Shell Epoxy)" should read --Shell Oil Epoxy)--.
Line 19, "of the" should read --of an antioxidant according to Example 1-2 was added so that the--.
Line 51, "Inc.]" should read --Inc.].--.

COLUMN 29

Line 48, "Oil Shell Epoxy)" should read --Shell Oil Epoxy)--.

COLUMN 31

Line 43, "an" should read --An--.

COLUMN 32

Line 38, "The," should read --Then,--.

COLUMN 33

Line 7, "buthanediol)" should read --butanediol)--.
Line 25, "Inc.]" should read --Inc.)].--.
Line 36, "80°C.)" should read --80°C.)]--.
Line 66, "rein" should read --resin--.

UNITED STATES PATENT AND TRADEMARK OFFICE

CERTIFICATE OF CORRECTION

PATENT NO. : 5,292,603

DATED : March 8, 1994

INVENTOR(S) : KIYOSHI SAKAI, ET AL

It is certified that error appears in the above-indentified patent and that said Letters Patent is hereby corrected as shown below:

COLUMN 34

Line 9, "1 μ," should read --1 μm--.
Line 22, "result" should read --result,--.

COLUMN 37

Line 2, "particularity" should read --particularity,--.
Line 5, "combination" should read --combinations--.
Line 26, "rein" should read --resin--.
Line 33, "in" should read --is--.
Line 37, "claim 9," should read --claim 8,--.
Line 38, "not" should read --no--.
Line 41, "claim 8" should read --claim 8,--.
Line 44, "claim 10" should read --claim 10,--.
Line 47, "claim 11" should read --claim 11,--.

COLUMN 38

Line 1, "claim 1" should read --claim 1,--.
Line 6, "tive." should read --tive layer.--.

UNITED STATES PATENT AND TRADEMARK OFFICE

CERTIFICATE OF CORRECTION

PATENT NO. : 5,292,603

DATED : March 8, 1994

INVENTOR(S) : KIYOSHI SAKAI, ET AL

It is certified that error appears in the above-indentified patent and that said Letters Patent is hereby corrected as shown below:

COLUMN 38

Line 29, "from a" should read --from the group consisting of a--.

Signed and Sealed this

Twenty-seventh Day of September, 1994

*Attest:*

*Attesting Officer*

BRUCE LEHMAN

*Commissioner of Patents and Trademarks*